US006988945B2

(12) United States Patent
Nicastro et al.

(10) Patent No.: US 6,988,945 B2
(45) Date of Patent: Jan. 24, 2006

(54) COIN COLLECTION SYSTEM FOR A GAMING MACHINE

(75) Inventors: Louis J. Nicastro, Palm Beach, FL (US); Wayne H. Rothschild, Northbrook, IL (US); Norman R. Wurz, DesPlaines, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

(21) Appl. No.: 10/985,419

(22) Filed: Nov. 10, 2004

(65) Prior Publication Data

US 2005/0085302 A1 Apr. 21, 2005

Related U.S. Application Data

(63) Continuation of application No. 10/361,521, filed on Feb. 10, 2003, now Pat. No. 6,852,022, which is a continuation-in-part of application No. 09/924,666, filed on Aug. 8, 2001, now Pat. No. 6,817,463.

(51) Int. Cl.
*G07D 1/00* (2006.01)

(52) U.S. Cl. ..... 453/18; 273/148 R; 194/350

(58) Field of Classification Search ..... 194/350; 193/DIG. 1; 273/148 R, 309, 138.2; 463/20, 463/46, 47; 453/18, 29, 37
See application file for complete search history.

(56) References Cited

U.S. PATENT DOCUMENTS

| | | | | |
|---|---|---|---|---|
| 480,360 | A | 8/1892 | Avery | |
| 1,885,582 | A | 11/1932 | Brandt | |
| 2,337,625 | A | 12/1943 | Sacksteder | |
| 2,561,880 | A | 7/1951 | Nicolaus et al. | |
| 4,122,932 | A | 10/1978 | Neubert et al. | 193/5 |
| 5,715,928 | A * | 2/1998 | Bradley | 194/344 |
| 6,047,966 | A * | 4/2000 | Hishinuma et al. | 273/143 R |
| 6,102,394 | A | 8/2000 | Wurz et al. | 273/138.2 |
| 6,578,847 | B1 * | 6/2003 | Hedrick et al. | 273/138.2 |
| 2003/0015397 | A1 | 1/2003 | Coulter | 194/353 |

FOREIGN PATENT DOCUMENTS

DE 3246815 A1 11/1982

* cited by examiner

*Primary Examiner*—Donald P. Walsh
*Assistant Examiner*—Mark J. Beauchaine
(74) *Attorney, Agent, or Firm*—Jenkens & Gilchrist

(57) ABSTRACT

A gaming machine comprises a cabinet, a coin outlet for dispensing coins, and a coin tray beneath the coin outlet. The coin tray is located a sufficient vertical distance from the coin outlet so as to accommodate a traditional coin collection cup between the coin outlet and the coin tray. The coin tray may contain a beverage cup holder and/or an ash tray, preferably located horizontally away from the coin outlet. The coin tray is coupled to the cabinet and extends below a level of the bottom of the cabinet. When the gaming machine sits on a stand in a gaming establishment, the cabinet sits on top of the stand while the coin tray hangs over a front wall of the stand.

13 Claims, 24 Drawing Sheets

COIN COLLECTION SYSTEM FOR A GAMING MACHINE

REFERENCE TO RELATED APPLICATIONS

"This application is a continuation of U.S. Ser. No. 10/361,521, filed Feb. 10, 2003, now U.S. Pat. No. 6,852,022 which is continuation-in-part of U.S. Ser. No. 09/924,666, filed Aug. 8, 2001 now U.S. Pat. No. 6,817,463 both of which are incorporated by reference in their entireties."

FIELD OF THE INVENTION

The present invention relates generally to a collection of coins dispensed from a gaming machine and, more particularly, relates to a coin collection system that facilitates the transfer of dispensed coins to a coin collection cup typically provided by a gaming establishment. The term "coins" is intended to cover coins, chips, or tokens representing monetary value. The coins may be a medium of monetary exchange of a country, territory, gaming establishment, or other entity.

BACKGROUND OF THE INVENTION

Gaming machines may be used to play a variety of games of chance, such as slots, poker, bingo, keno, and blackjack, in response to a wager. Any winnings resulting from play of a gaming machine are typically either stored on the machine as credits or immediately dispensed as coins from the machine's coin hopper into a coin tray. If the winnings are stored on the machine as credits, the machine dispenses a number of coins corresponding to the number of credits from the coin hopper into the coin tray in response to actuation by the player of a "cash out" or "collect" key. To take the coins with him or her, the player generally must transfer the coins from the coin tray to a coin collection cup by grabbing and carrying the coins, one handful at a time, from the coin tray to the coin collection cup.

A major drawback of the foregoing procedure for collecting coins is that dirt and metal from the coins is readily transferred to the player's hand or hands. To alleviate the problem of dirty hands, gaming establishments have attempted a couple solutions.

First, some gaming establishments provide hand wipes at their currency exchange counters. Nonetheless, it is inconvenient for a player to have to perform the extra step of cleaning his or her hands following play of a gaming machine. In addition, the player must walk around with dirty hands until the player has access to the hand wipes or a bathroom that is often remotely located. Moreover, hand wipes only do a fair job of cleaning one's hands. Players who are particularly sensitive to sanitary conditions may not be satisfied by hand wipes and may even have reservations about playing gaming machines that require a player to collect coins as described above.

Second, other gaming establishments now provide coinless gaming machines that dispense tickets, vouchers, or cards instead of coins. While such machines eliminate the problem of dirty hands caused by coins, there is still an ongoing demand from both players and gaming establishments for gaming machines that dispense coins. It has been found that a significant segment of the market still prefers gaming machines that dispense coins because of the "buzz" and excitement generated by coins falling into the coin tray.

SUMMARY OF THE INVENTION

Accordingly, the present invention is directed to a coin collection system for a gaming machine that facilitates the transfer of dispensed coins to a coin collection cup and, at the same time, minimizes the problem of dirty hands.

The gaming machine comprises a cabinet, a coin outlet for dispensing coins, and a coin tray beneath the coin outlet. The coin tray is located a sufficient vertical distance from the coin outlet so as to accommodate a traditional coin collection cup between the coin outlet and the coin tray. The coin tray may contain a beverage cup holder and/or an ash tray, preferably located horizontally away from the coin outlet. The coin tray is coupled to the cabinet and extends below a level of the bottom of the cabinet. When the gaming machine sits on a stand in a gaming establishment, the cabinet sits on top of the stand while the coin tray hangs over a front wall of the stand.

BRIEF DESCRIPTION OF THE DRAWINGS

The foregoing and other advantages of the invention will become apparent upon reading the following detailed description and upon reference to the drawings.

Figure 1:
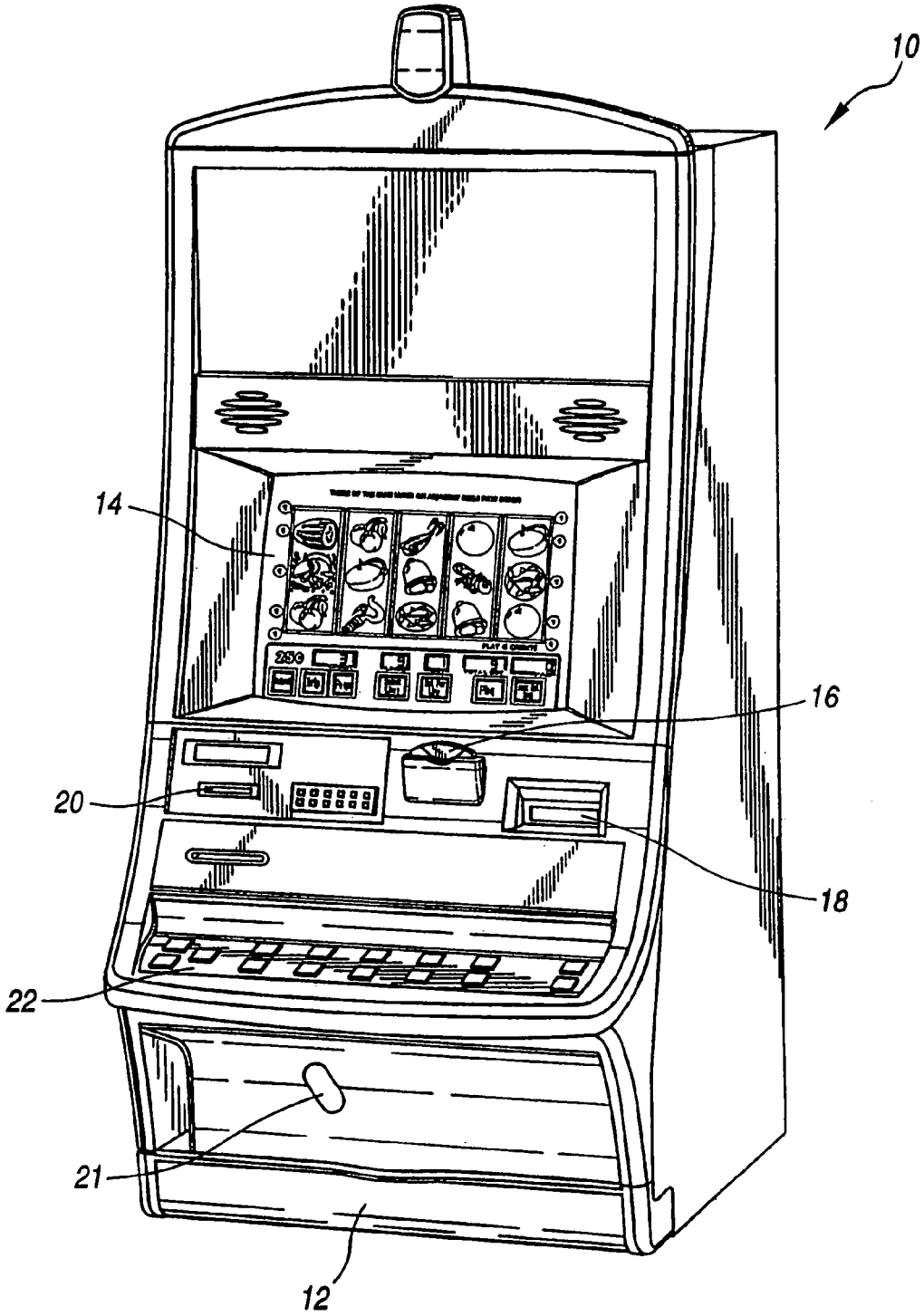
FIG. 1 is an isometric view of a gaming machine with conventional coin tray.
Figure 2A:
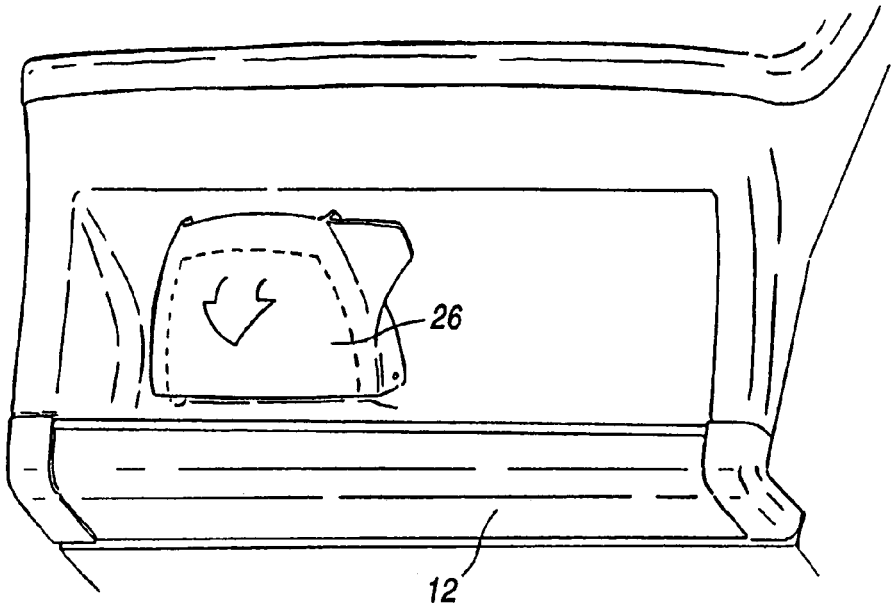
FIGS. 2*a*, 2*b*, 2*c*, and 2*d* are enlarged isometric views of a coin collection system according to a first embodiment of the present invention.
Figure 2B:
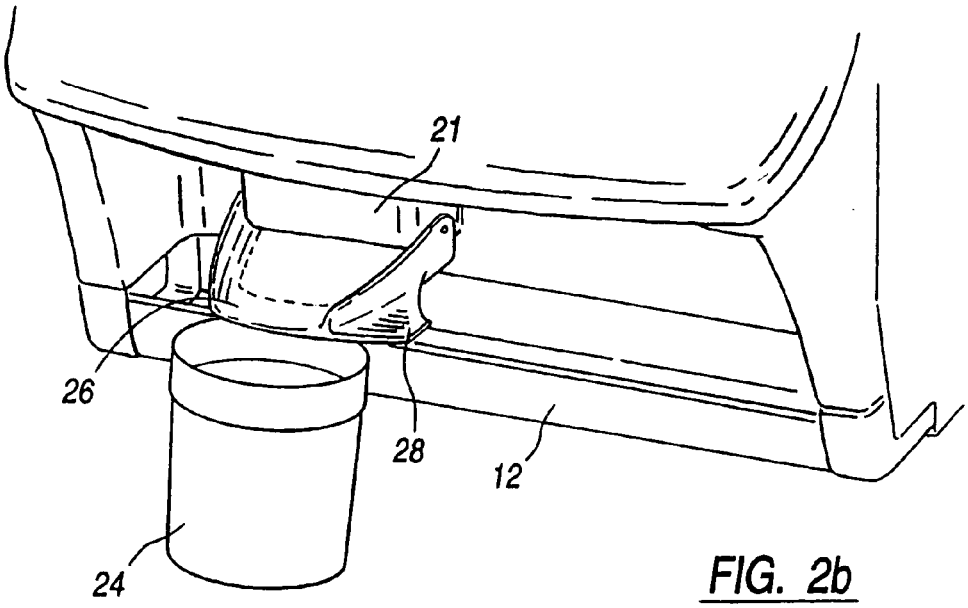
Figure 2C:
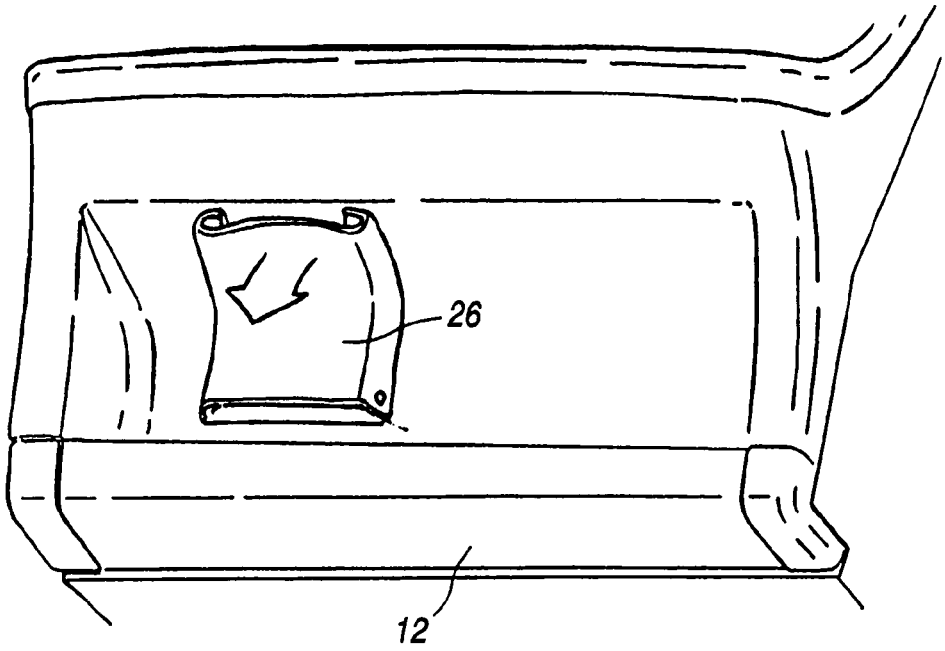
Figure 2D:
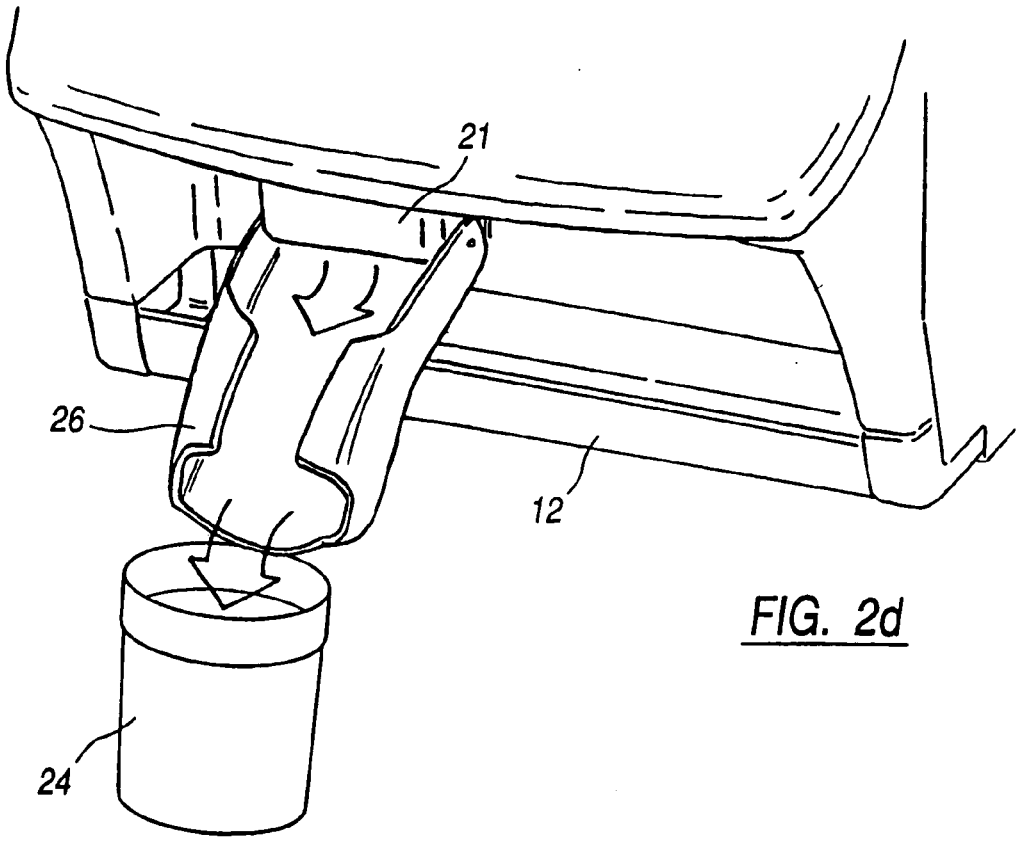

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to the drawings, where like reference numerals are generally used to identify analogous (although not necessarily identical) parts, FIG. 1 depicts a gaming machine 10 including a conventional coin tray 12. The machine 10 may be used to play a variety of games of chance, such as slots, poker, bingo, keno, and blackjack. The game of chance is stored in memory either within the machine 10 or remote from the machine 10. In response to a wager, a processing unit executes the game by randomly selecting one of a plurality of possible outcomes and causing a mechanical or video display 14 to depict indicia corresponding to the selected outcome. The wager may, for example, be in the form of coins inserted into a coin entry slot 16; paper currency, tickets, or vouchers inserted into a bill validator 18; or a credit card, magnetic card, or smart card inserted into a card entry slot 20.

Any monetary winnings resulting from play of the gaming machine 10 are either stored on the machine 10 as credits or immediately dispensed as coins from the machine's coin hopper (not shown), through a coin outlet 21, and into the coin tray 12 beneath the coin outlet 21. If the winnings are stored on the machine 10 as credits, the machine 10 dispenses a number of coins corresponding to the number of credits from the coin hopper into the coin tray 12 in response to actuation by the player of a "cash out" or "collect" key on a button panel 22. To take the coins with him or her, the player generally must transfer the coins from the coin tray 12 to a coin collection cup 24 by grabbing and carrying the coins, one handful at a time, from the coin tray 12 to the coin collection cup 24. The coin collection cup 24 is typically a large molded plastic cup that can be obtained from a stack of cups provided by the gaming establishment near a bank of gaming machines including the gaming machine 10. The present invention is directed to a coin collection system for a gaming machine that facilitates the transfer of dispensed coins to the coin collection cup 24 and, at the same time, minimizes the problem of dirty hands.

Figure 21A:
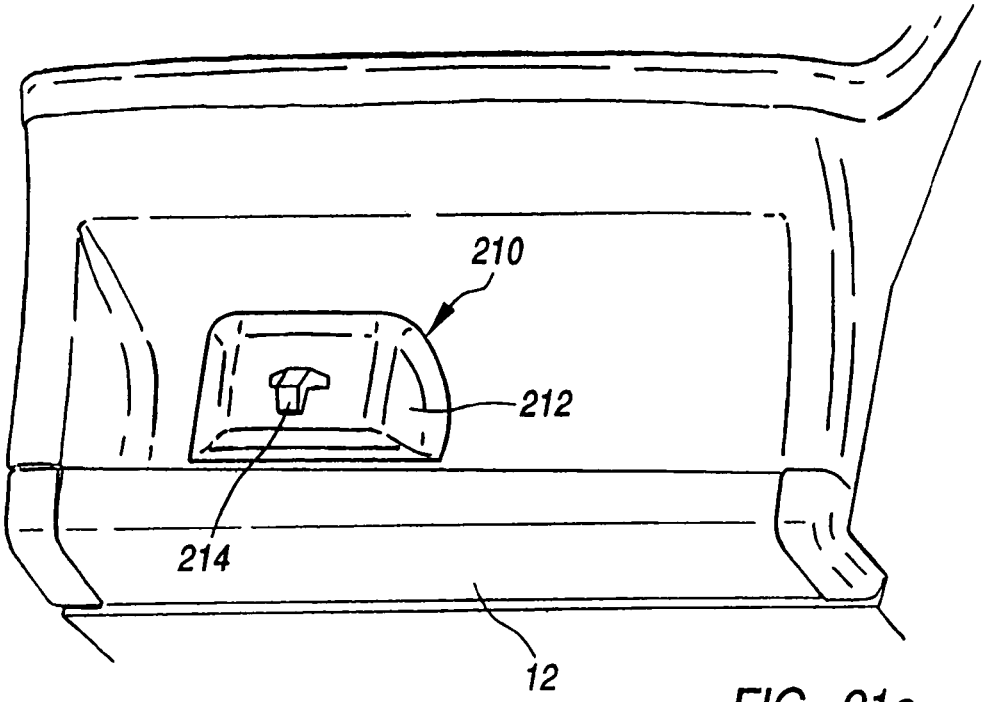
FIGS. 21*a* and 21*b* are enlarged isometric views of a coin collection system according to a twentieth embodiment of the present invention.
Figure 21B:
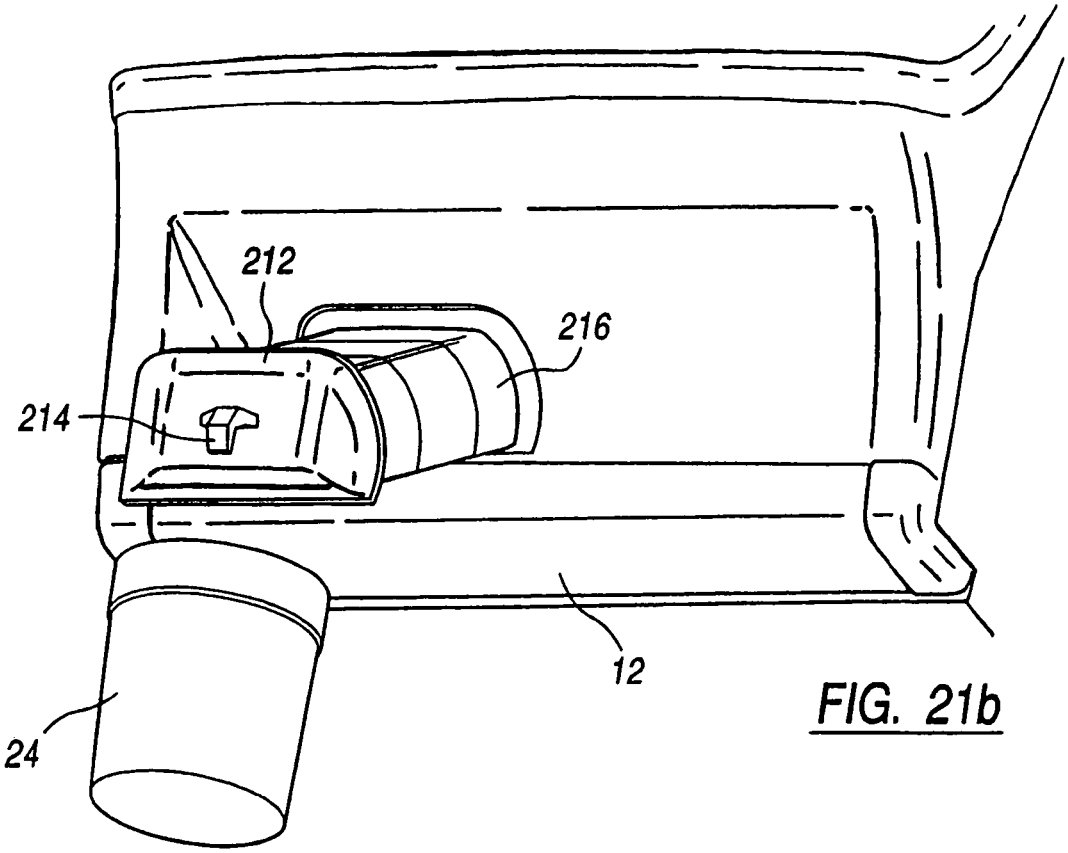

In accordance with one aspect of the present invention shown generally in FIGS. 2*a–d* through 14*a–b* and in FIGS. 21*a–b*, the coin collection system comprises the coin outlet 21, the coin tray 12, and a guiding arrangement. The guiding arrangement includes a movable member coupled to the gaming machine and operable to assist in guiding the dispensed coins from either the coin outlet 21 or the coin tray 12 to a coin collection cup 24.

More specifically, referring to FIGS. 2*a*, 2*b*, 2*c*, and 2*d*, the movable member may include a fold-out spout 26 hinged to the coin outlet 21. The spout 26 is rotatable between a disabled vertical position and an enabled horizontal position. When the spout 26 is in the disabled vertical position (FIGS. 2*a* and 2*c*), the spout 26 permits the dispensed coins to drop into the coin tray 12. When, however, the spout 26 is in the enabled horizontal position (FIGS. 2*b* and 2*d*), the spout 26 extends over the coin tray 12 and diverts the dispensed coins to a coin collection cup 24 held by a player in front of the coin tray 12. The spout 26 is optionally biased towards the disabled position and may include a grab tab 28 (see FIG. 2*b*) to be grabbed by a player when pivoting the spout 26 downward to the enabled position.

Figure 3A:
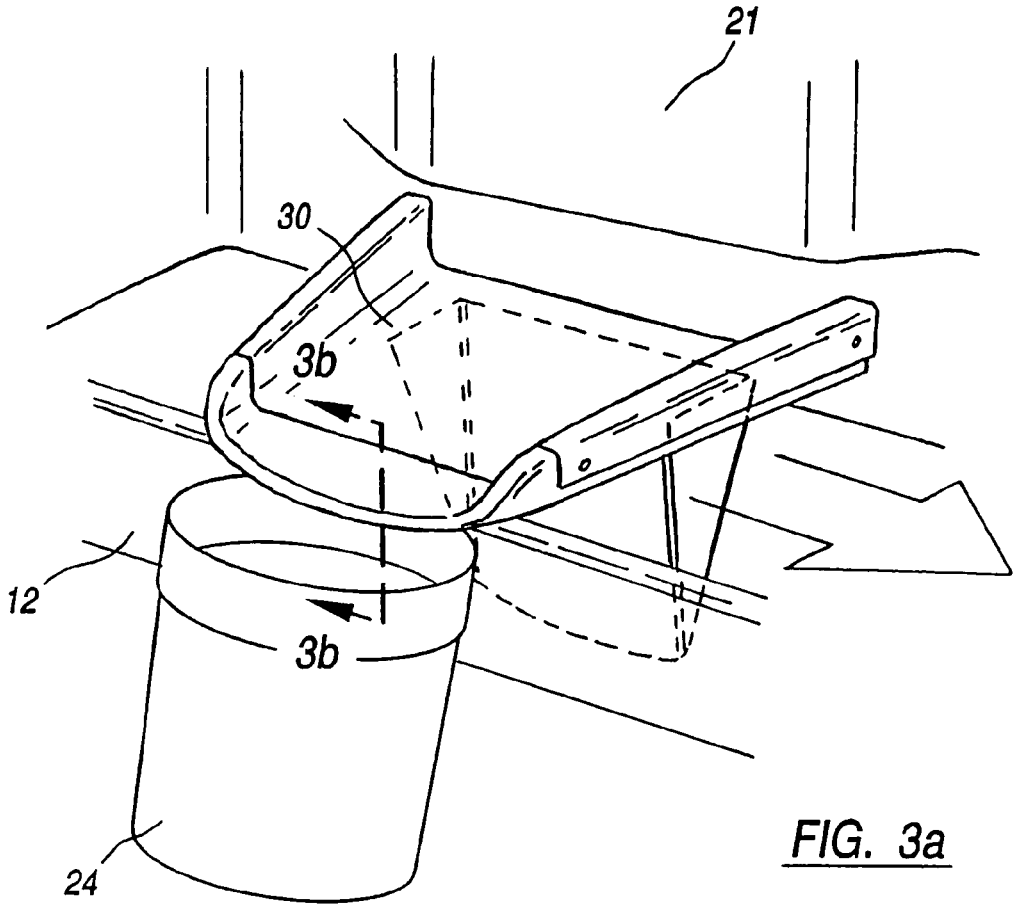
FIG. 3*a* is an enlarged isometric view of a coin collection system according to a second embodiment of the present invention.
Figure 3B:
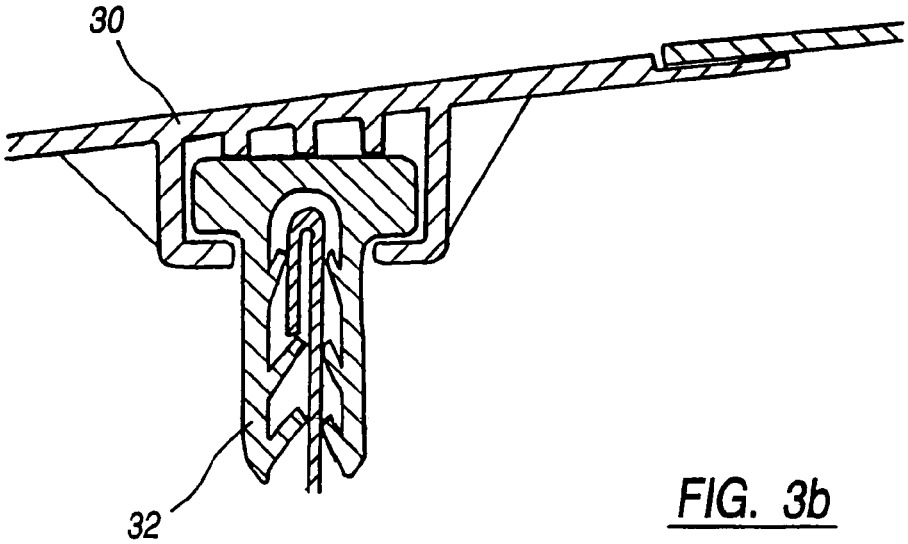
FIG. 3*b* is a sectional view taken generally along line 3*b*—3*b* in FIG. 3*a;*

Referring to FIGS. 3*a* and 3*b*, instead of the hinged spout 26, the movable member may include a spout 30 slidably mounted to a support 32. The spout 30 is slidable between a disabled position and an enabled position. To move the spout 30 from the enabled position to the disabled position, the spout 30 is slid away from beneath the coin outlet 21 in the direction of the arrow in FIG. 3*a* so that the dispensed coins can drop into the coin tray 12 without encountering the spout 30. When, however, the spout 30 is in the enabled position as shown in FIG. 3*a*, the spout 30 is positioned between the coin outlet 21 and the coin tray 12 so that it diverts the dispensed coins to a coin collection cup 24 held by a player in front of the coin tray 12.

Figure 4A:
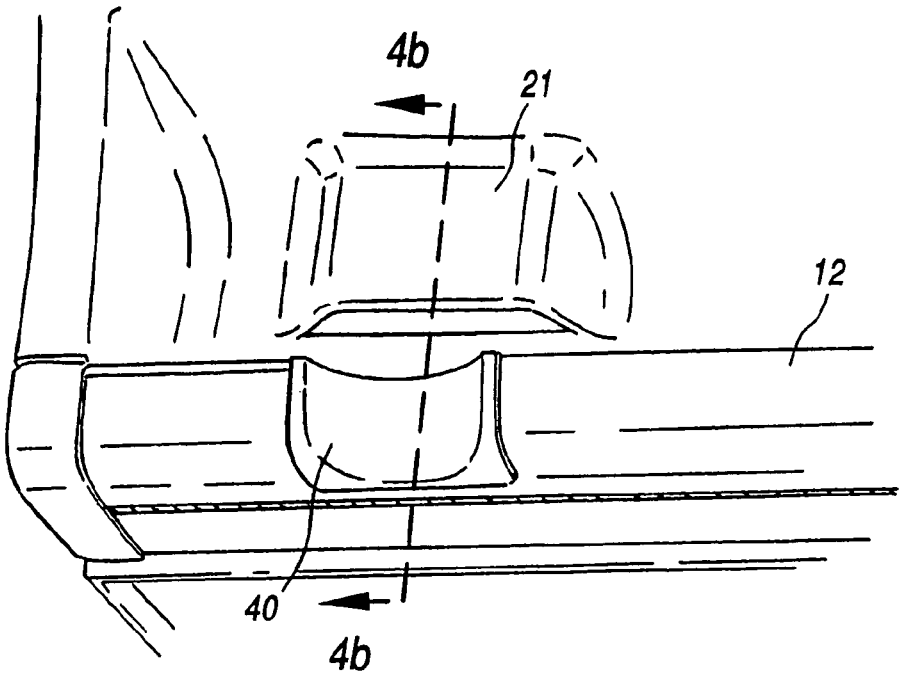
FIG. 4*a* is an enlarged isometric view of a coin collection system according to a third embodiment of the present invention.
Figure 4B:
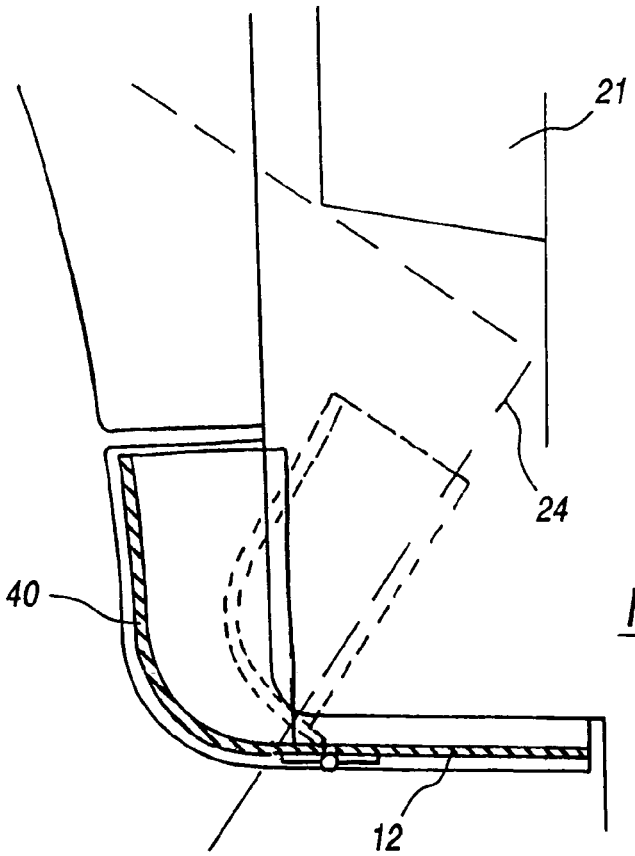
FIG. 4*b* is a sectional view taken generally along line 4*b*—4*b* in FIG. 4*a;*
Figure 5A:
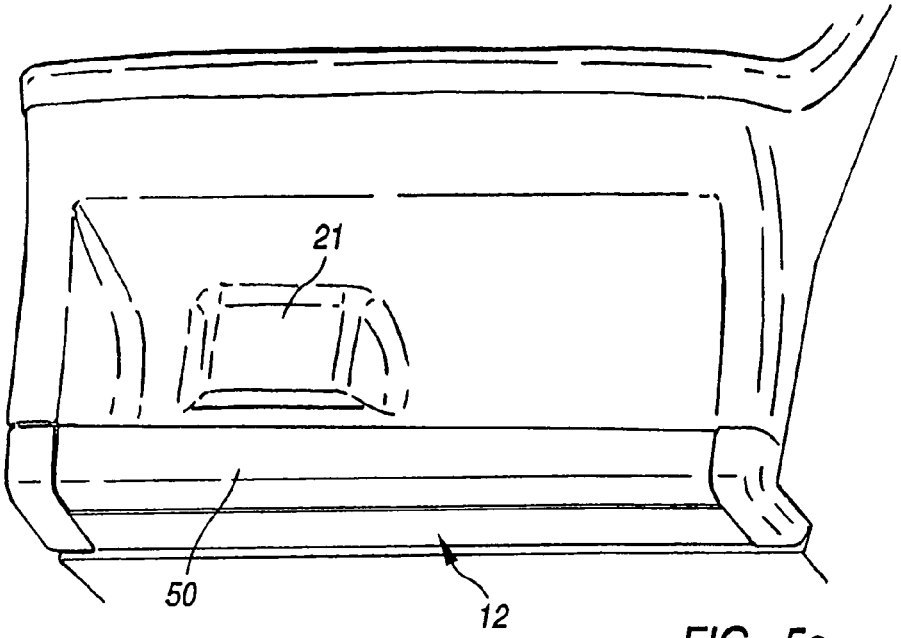
FIGS. 5*a* and 5*b* are enlarged isometric views of a coin collection system according to a fourth embodiment of the present invention.
Figure 5B:
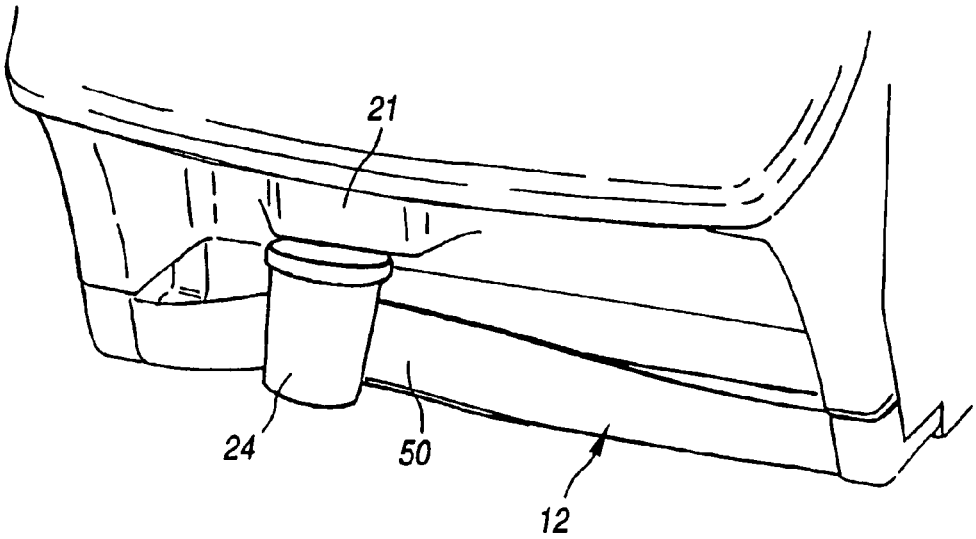
Figure 6A:
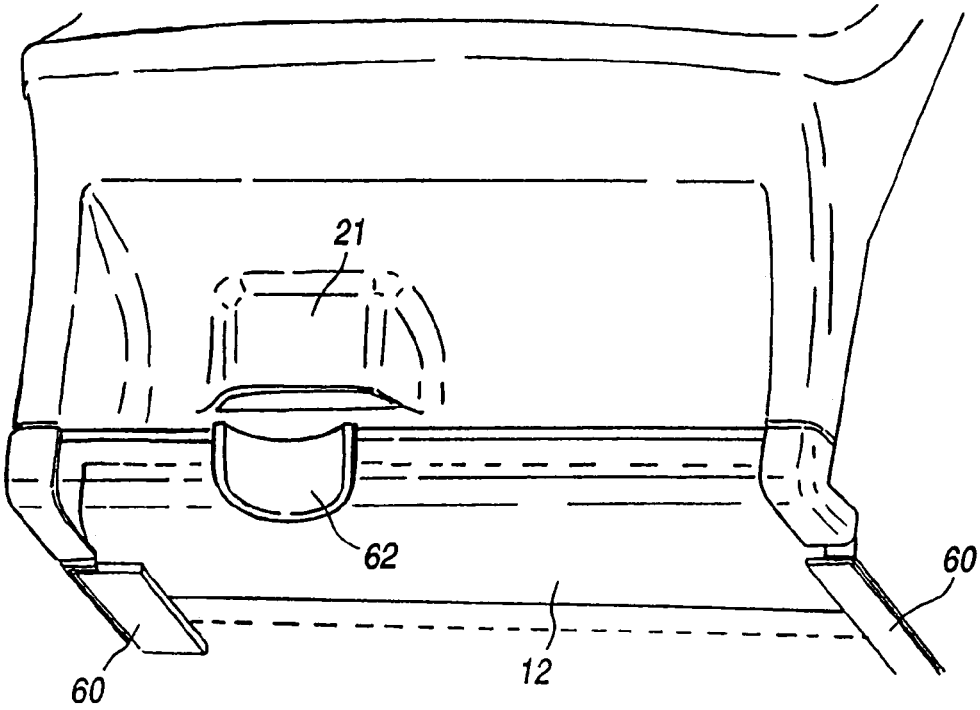
FIGS. 6*a* and 6*b* are enlarged isometric views of a coin collection system according to a fifth embodiment of the present invention.
Figure 6B:
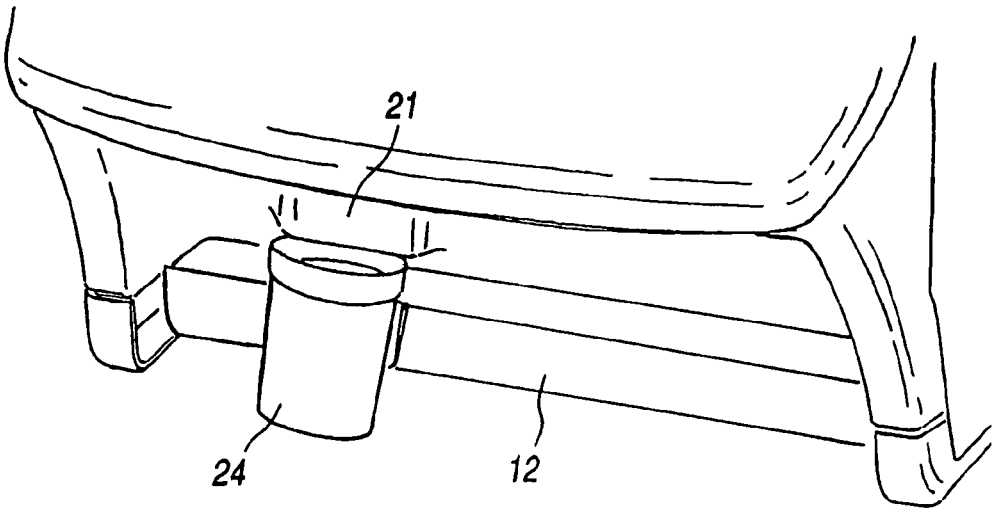
Figure 7A:
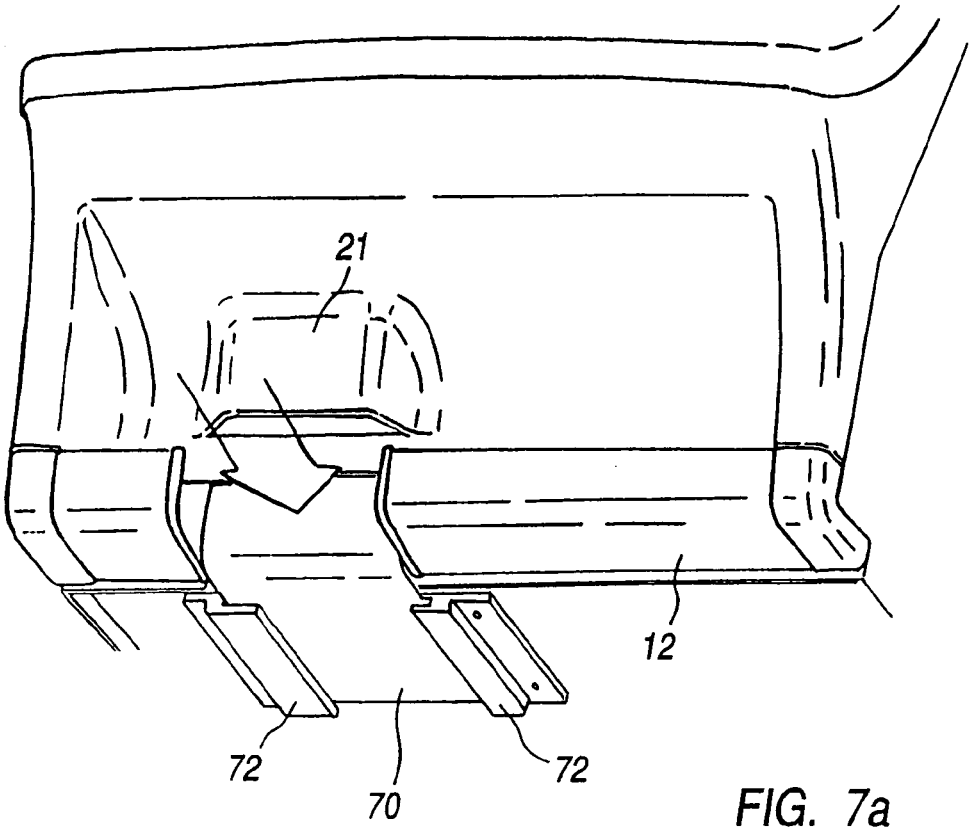
FIGS. 7*a* and 7*b* are enlarged isometric views of a coin collection system according to a sixth embodiment of the present invention.
Figure 7B:
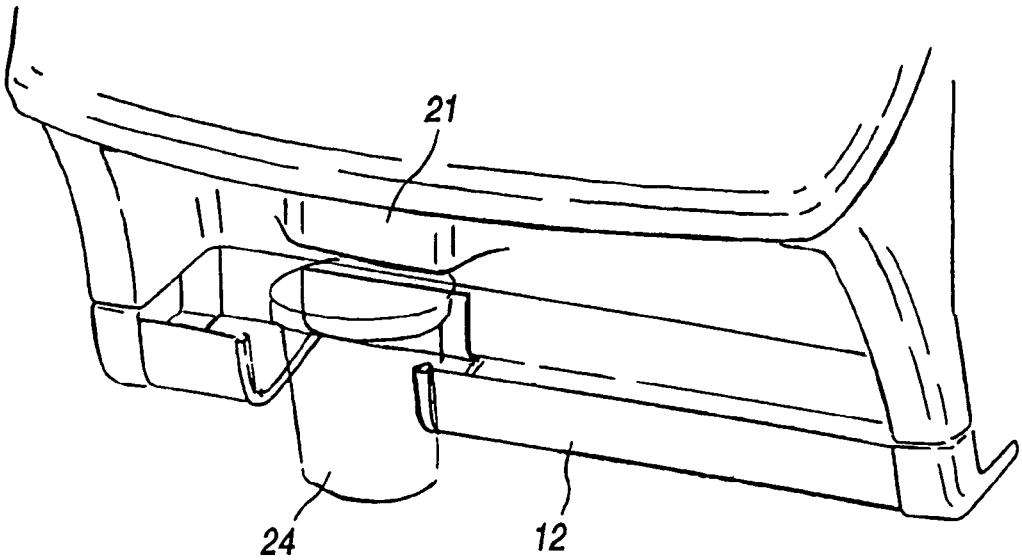

Referring to FIGS. 4*a–b*, 5*a–b*, 6*a–b*, and 7*a–b*, the movable member may form at least a portion of the coin tray 12. In response to being pressed by the coin collection cup 24, the member moves inward so that the coins dispensed from the coin outlet 21 are directly captured by a coin collection cup 24 instead of the coin tray 12. Referring to FIGS. 4*a* and 4*b*, the movable member includes a hinged concave panel 40. Referring to FIGS. 5*a* and 5*b*, the movable member is flexible and formed by an entire front wall 50 of the coin tray 12. The front wall 50 may, for example, be made of some type of rubber. In response to being pressed by the coin collection cup 24, the front wall 50 flexes inward so that the coins dispensed from the coin outlet 21 are directly captured by the coin collection cup 24. Instead of forming the entire front wall 50 of a flexible material, this embodiment may be modified to form only the wall section in front of the coin outlet 21 of the flexible material. Referring to FIGS. 6*a* and 6*b*, the movable member includes the coin tray 12 itself or at least the front wall of the coin tray 12. In response to being pressed by the coin collection cup 24, the coin tray 12 slides inward along rails 60. A front wall section 62 of the coin tray 12 is preferably indented or concave to assist the player in properly positioning the coin collection cup 24 in front of the coin outlet 21. Referring to FIGS. 7*a* and 7*b*, instead of sliding the entire coin tray 12 inward, this embodiment may be modified to slide only a section 70 of the coin tray 12 in front of the coin outlet 21. The section 70 slides along rails 72.

Figure 8A:
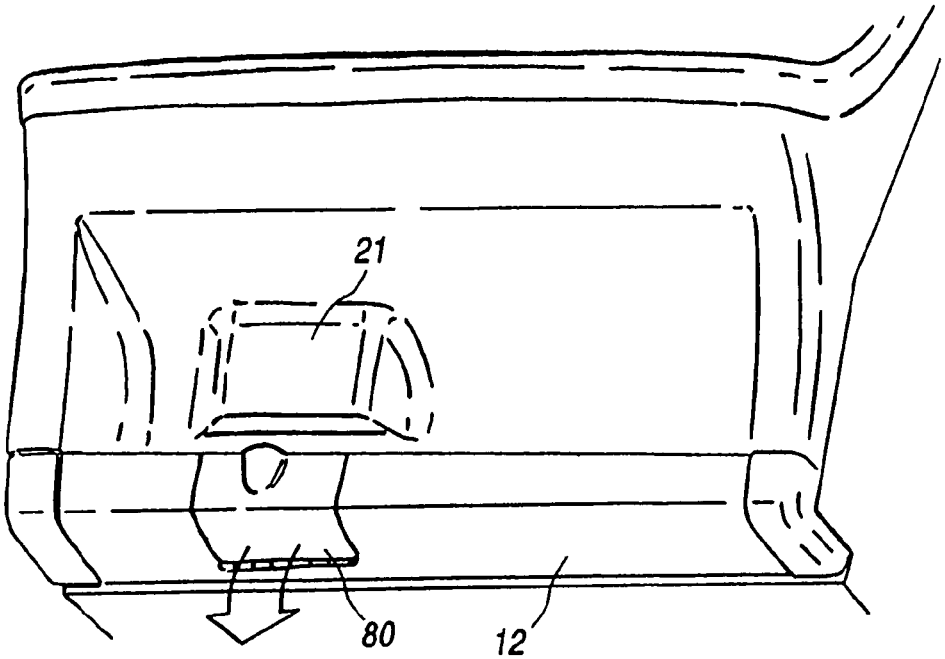
FIGS. 8*a* and 8*b* are enlarged isometric views of a coin collection system according to a seventh embodiment of the present invention.
Figure 8B:
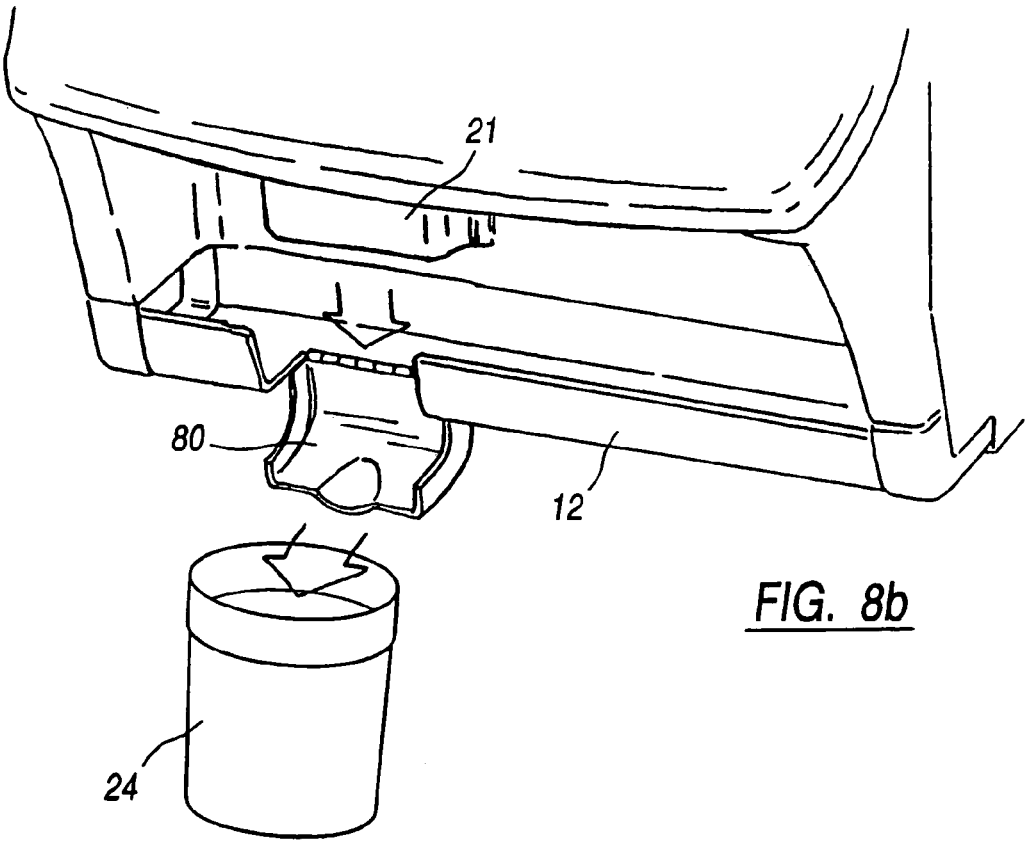
Figure 9A:
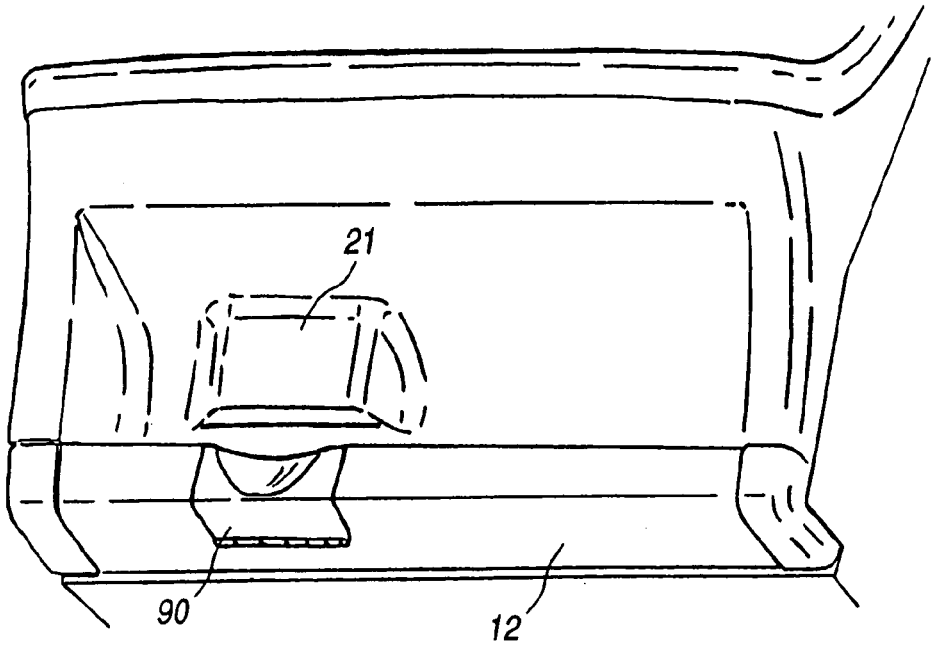
FIGS. 9*a* and 9*b* are enlarged isometric views of a coin collection system according to an eighth embodiment of the present invention.
Figure 9B:
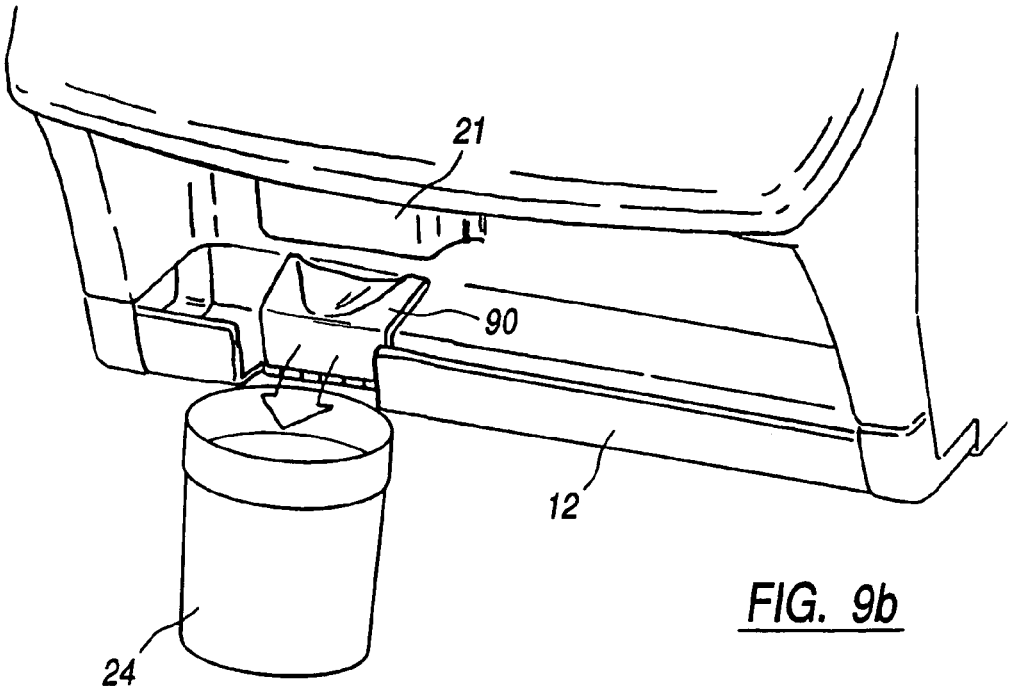

Referring to FIGS. 8*a–b*, 9*a–b*, 10*a–b*, and 1*a–b*, the movable member may form at least a portion of the coin tray 12 and be movable between a disabled position and an enabled position. The movable member maintains the dispensed coins in the coin tray 12 when the member is in the disabled position, but helps to guide the coins out of the coin tray 12 when the member is in the enabled position. The movable member is optionally biased towards the disabled position. Referring to FIGS. 8*a* and 8*b*, the movable member is a hinged access panel 80 proximate the coin outlet 21. The hinged panel 80 closes at least one wall of the coin tray 12 when the panel 80 is in the disabled position (FIG. 8*a*) and opens the at least one wall of the coin tray 12 when the panel 80 is in the enabled position (FIG. 8*b*). In the illustrated embodiment, the hinged panel 80 wraps around the front and bottom walls of the coin tray 12 and is converted into a pour spout when opened by rotating the panel 80 downward. Referring to FIGS. 9*a* and 9*b*, the hinged access panel 90 is similar to the panel 80 in FIGS. 8*a* and 8*b* except that it opens by rotating upward instead of downward.

Figure 10A:
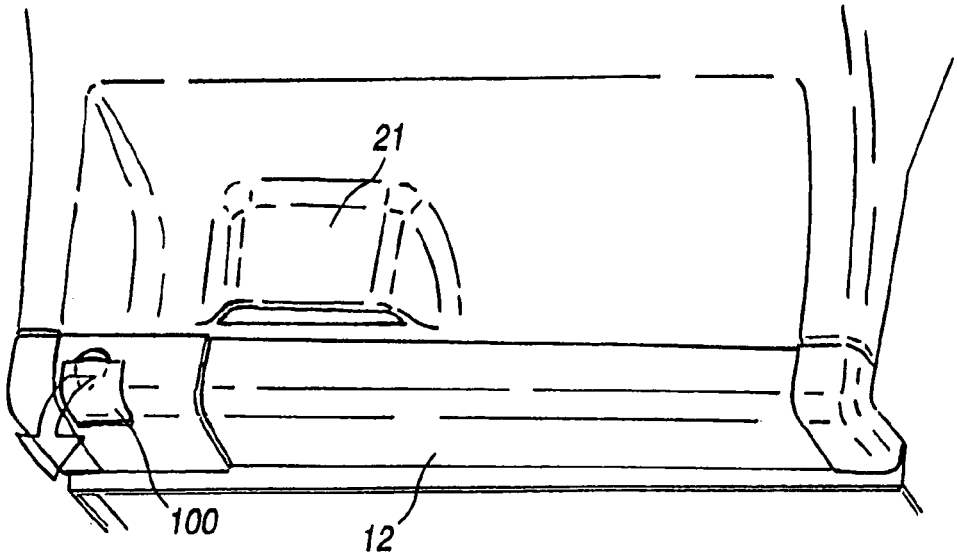
FIGS. 10*a* and 10*b* are enlarged isometric views of a coin collection system according to a ninth embodiment of the present invention.
Figure 10B:
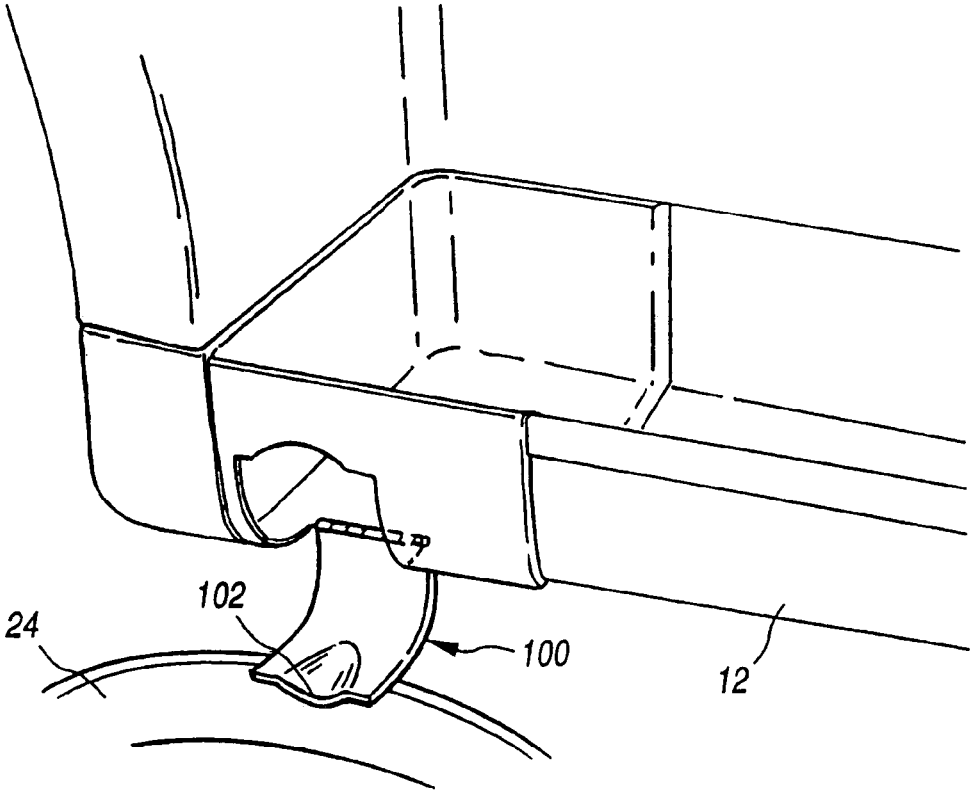
Figure 11A:
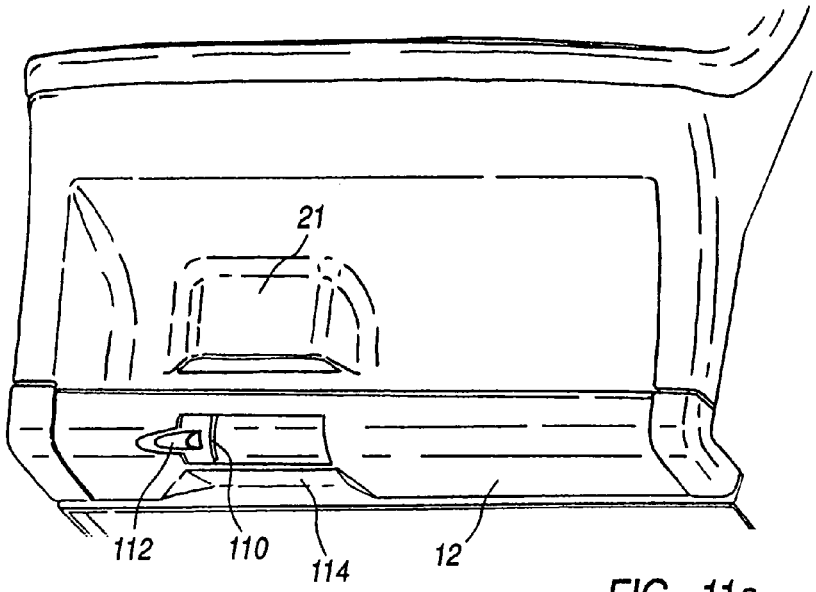
FIGS. 11*a* and 11*b* are enlarged isometric views of a coin collection system according to a tenth embodiment of the present invention.
Figure 11B:
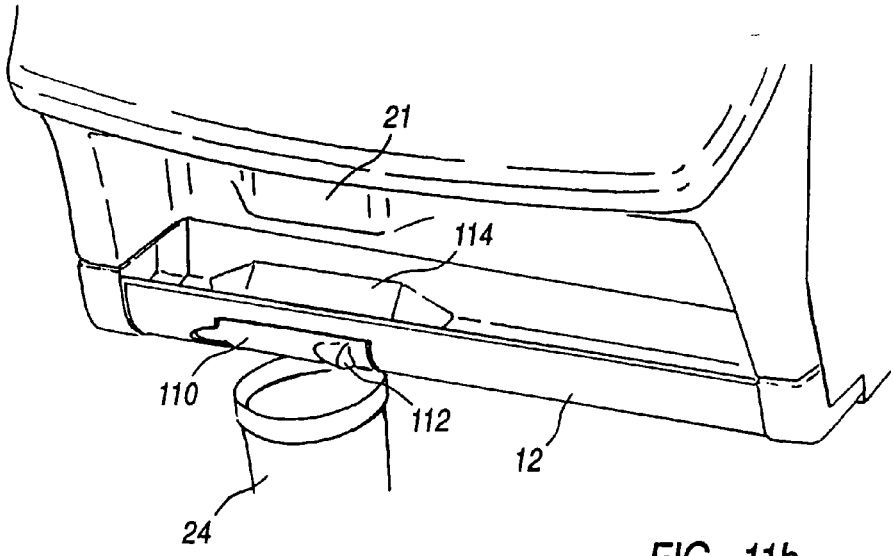

Referring to FIGS. 10*a–b* and 11*a–b*, the movable member is an access panel that is smaller than the access panels in FIGS. 8*a–b* and 9*a–b* and forms a hole in the coin tray 12 when opened. In FIGS. 10*a–b*, the access panel 100 is hinged, includes a protruding section 102 to facilitate opening, and is sufficiently large to allow the dispensed coins to pass through the hole left by the opened panel. In FIGS. 11*a–b*, the access panel 110 includes a handle 112 to aid the player in sliding the panel 110 between the disabled (closed) position in FIG. 11*a* and the enabled (open) position in FIG. 11*b*. In either embodiment, the coin tray 12 may form a ramp 114 (see FIGS. 11*a–b*) beneath the coin outlet 21. The ramp 114 helps to deflect the dispensed coins through the hole left by the opened access panel.

Figure 12A:
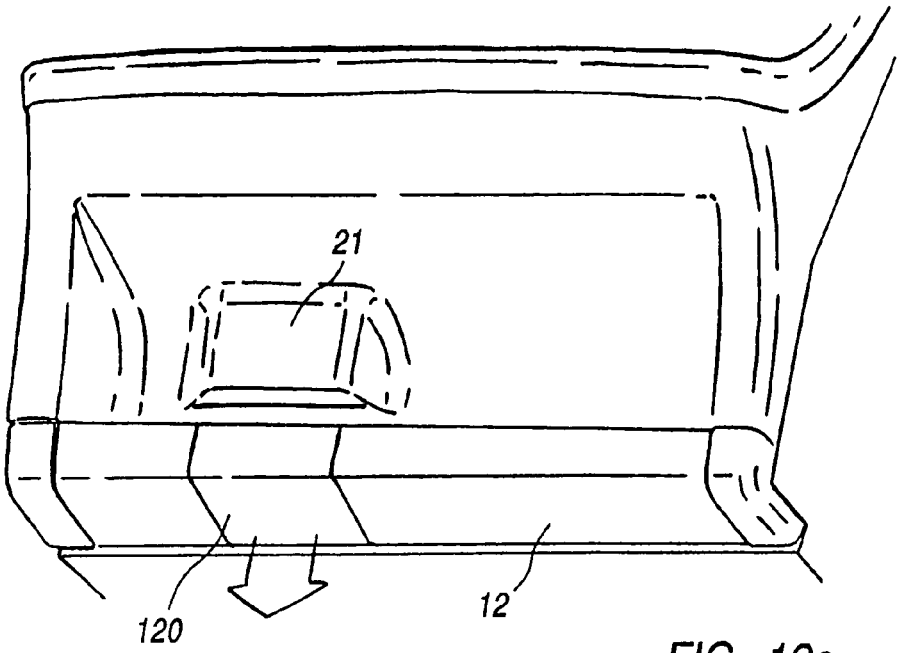
FIGS. 12*a* and 12*b* are enlarged isometric views of a coin collection system according to an eleventh embodiment of the present invention.
Figure 12B:
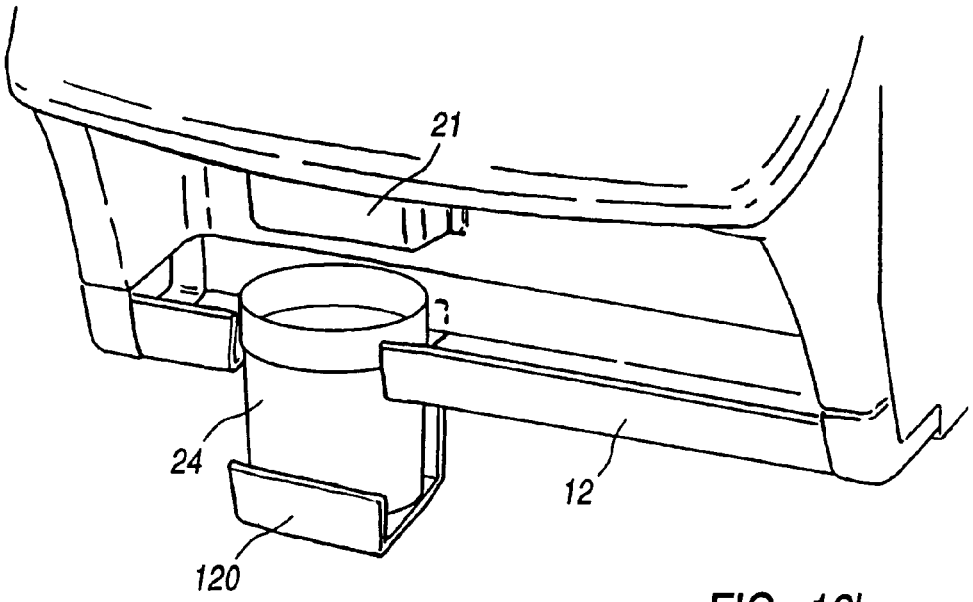

Referring to FIGS. 12*a* and 12*b*, the movable member may form at least a portion of the coin tray 12 and be movable between a disabled (upper) position and an enabled (lower) position. The movable member maintains the dispensed coins in the coin tray 12 when the member is in the disabled position (FIG. 12*a*). The movable member permits the coins dispensed from the coin outlet 21 to be directly captured by the coin collection cup 24 when the member is in the enabled position (FIG. 12*b*). The movable member preferably includes a cup supporting panel 120 for holding the coin collection cup 24 beneath the coin outlet 21 when the member is in the enabled (lower) position. The cup supporting panel 120 is vertically slidable between the disabled (upper) position and the enabled (lower) position.

Figure 13A:
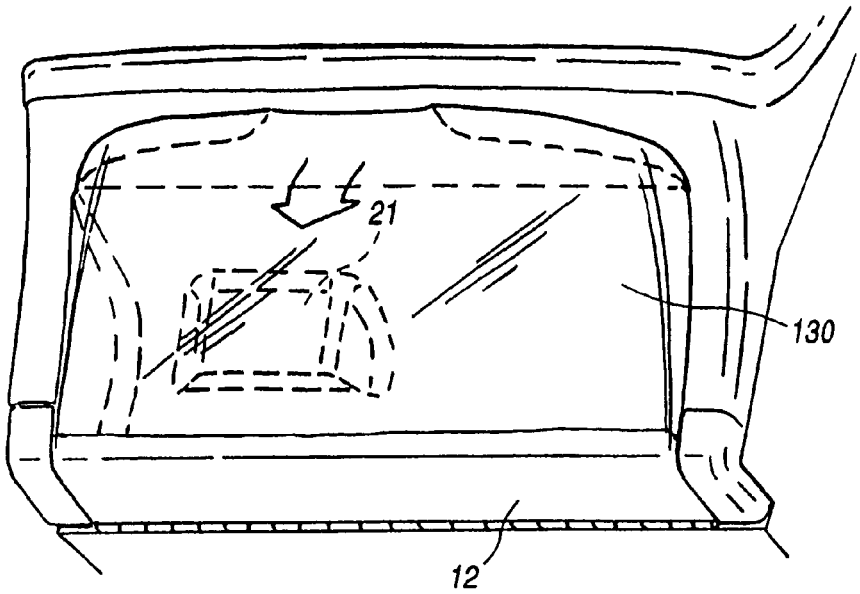
FIGS. 13*a* and 13*b* are enlarged isometric views of a coin collection system according to a twelfth embodiment of the present invention.
Figure 13B:
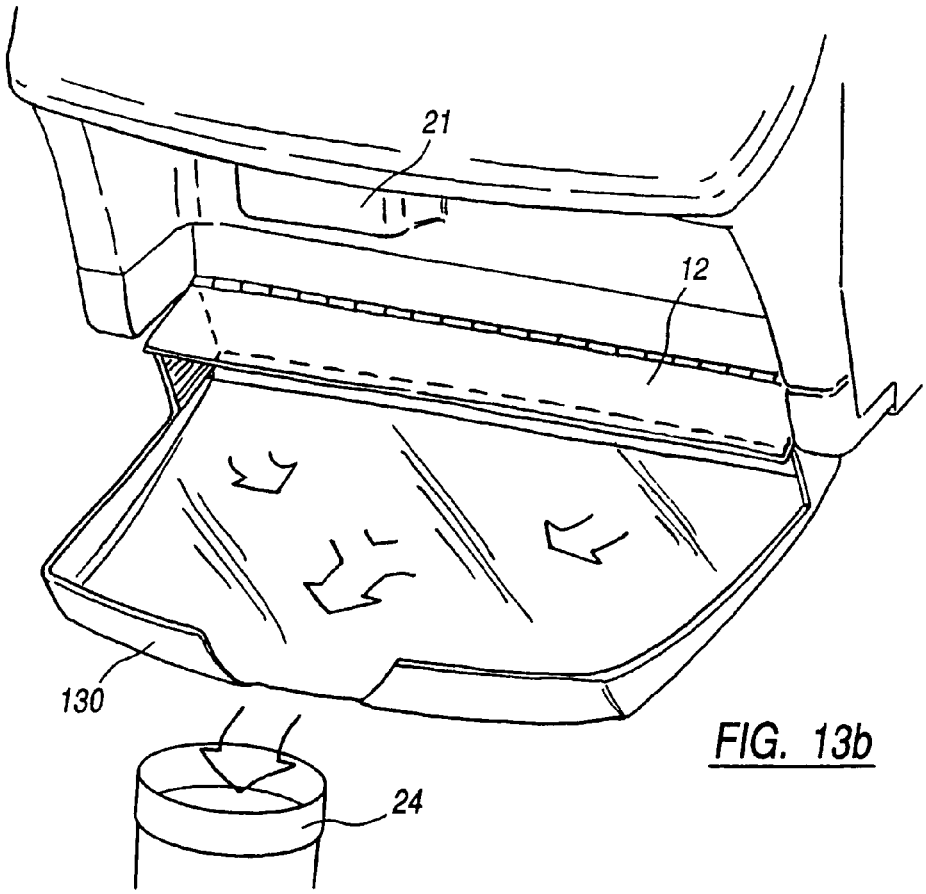

Referring to FIGS. 13*a* and 13*b*, the movable member may include the entire coin tray 12 itself. The coin tray 12 is hinged for movement between an upper position corresponding to the disabled position (FIG. 13*a*) and a forward-tilting position corresponding to the enabled position (FIG. 13*b*). The coin tray 12 includes a front wall 130 to assist in guiding the dispensed coins from the coin tray 12 into the coin collection cup 24 when the coin tray 12 is in the forward-tilting position. In the forward-tilting position, the coins collected in the coin tray 12 fall off an upper lip of a front wall 130 of the coin tray 12 and into a coin collection cup 24 held adjacent to the upper lip. The coin tray 12 may be configured with slopes, notches, or openings to actively channel the coins toward one section of the upper lip. The front wall 130 of the coin tray 12 may be extended in height so that the front wall not only carries coins as they are dumped into the collection cup 24, but also supports a lower artwork panel (e.g., "belly" glass) associated with the gaming machine.

Figure 14A:
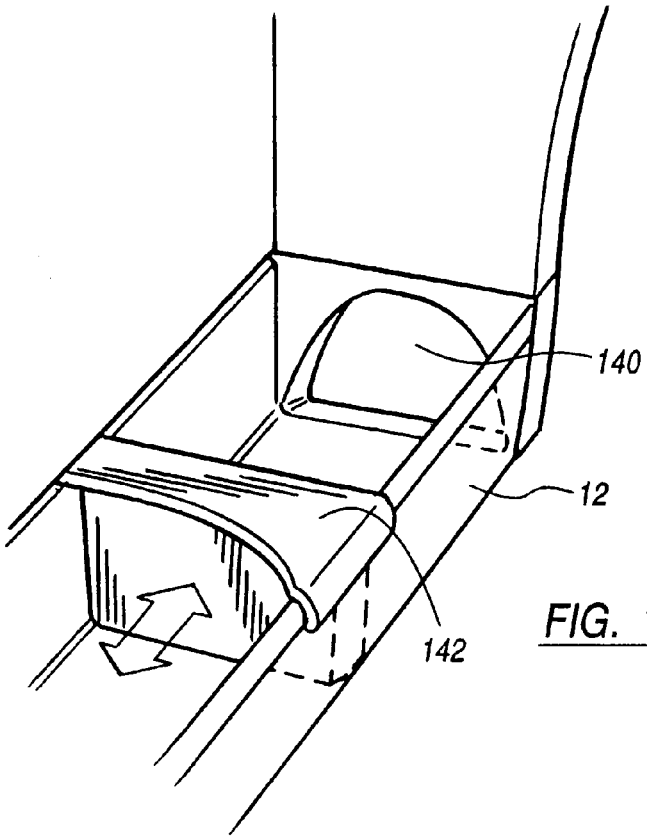
FIGS. 14*a* and 14*b* are enlarged isometric views of a coin collection system according to a thirteenth embodiment of the present invention.
Figure 14B:
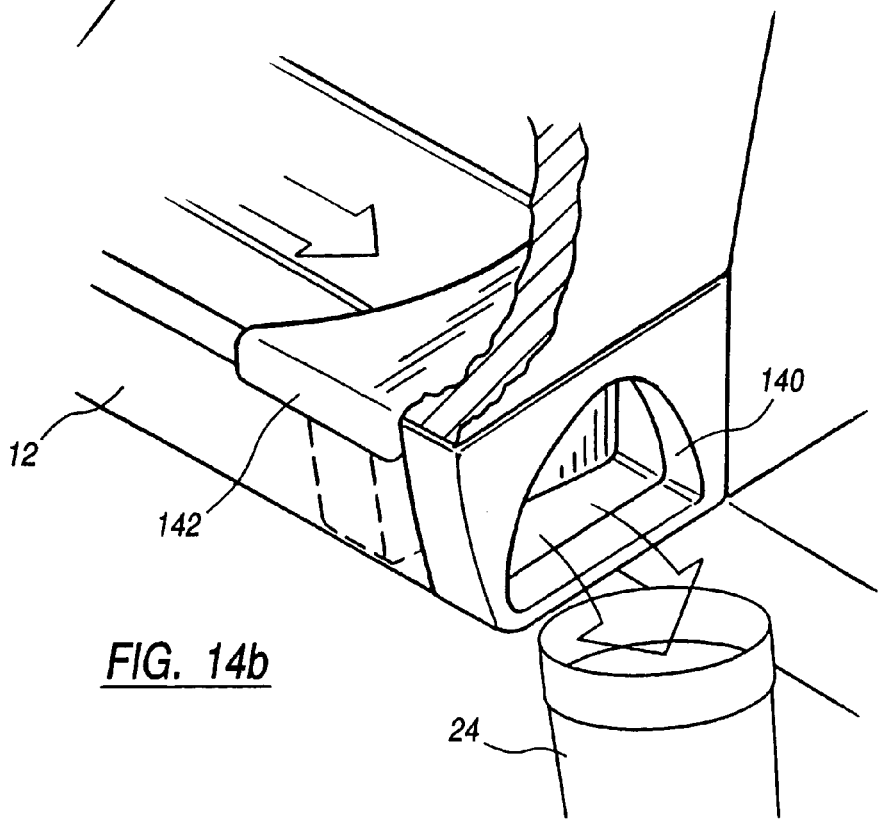

Referring to FIGS. 14*a* and 14*b*, the coin guiding arrangement may include an exit opening 140 in one end of the coin tray 12. In this case, the movable member includes a sliding bar 142 for sweeping coins in the coin tray 12 through the exit opening 140 and into the coin collection cup 24 when the cup 24 is held adjacent to the exit opening 140. The sliding bar 142 is slidably anchored to the coin tray 12 for movement between a first position to one side of both the exit opening 140 and the coin outlet and a second position adjacent to the exit opening 140.

Referring to FIGS. 21*a* and 21*b*, the movable member may be a spout 210 with an accordion side wall 216 for extending the spout 210 from a retracted position (FIG. 21*a*) and an extended position (FIG. 21*b*) in response to pulling on a pull tab 214. The spout 210 is preferably biased toward the retracted position and includes a front wall 212 with a lip to stop retraction. In the retracted position, the dispensed coins are collected directly in the coin tray 12. In the extended position, the dispensed coins may be collected in a coin collection cup 24 held in front of the coin tray 12. Instead of an accordion side wall 216, the side wall may be rigid such that the spout 210 slides in and out of the machine housing.

In accordance with another aspect of the present invention shown generally in FIGS. 15*a–c* through 17*a–b*, a coin collection system for a gaming machine comprises a coin outlet 21 for dispensing coins, a coin tray 12 beneath the coin outlet 21, and a guiding member. The guiding member is positioned proximate to the coin outlet 21 and operable to divert the dispensed coins away from the coin tray 12 and into a coin collection cup 24.

Figure 15A:
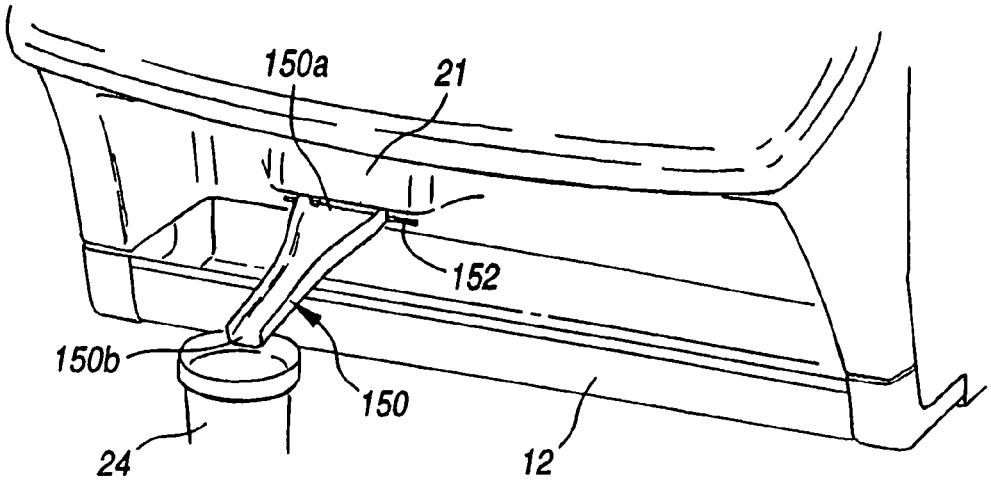
FIGS. 15*a*, 15*b*, and 15*c* are enlarged isometric views of a coin collection system according to a fourteenth embodiment of the present invention.
Figure 15B:
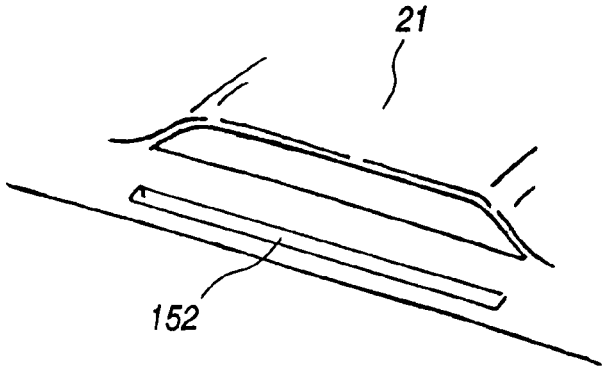
Figure 15C:
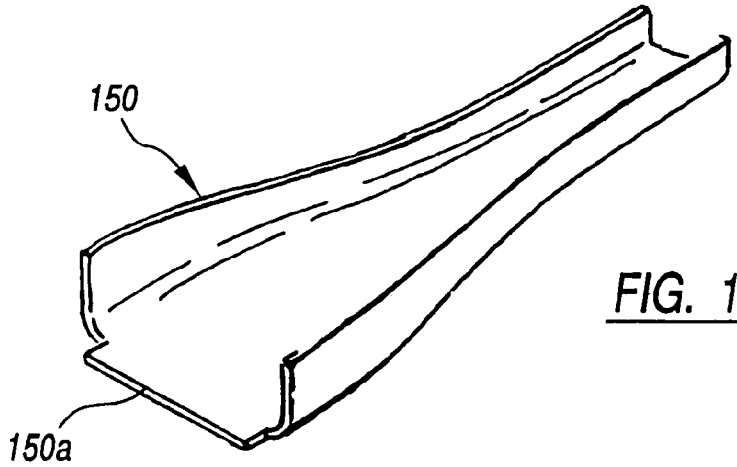

Referring to FIGS. 15*a*, 15*b*, and 15*c*, the guiding member may include a spout 150 detachably coupled to the gaming machine beneath the coin outlet 21 and extending over the coin tray 12. The spout 150 includes a first end 150*a* and a second end 150*b*. The first end 150*a* is hooked to a slot 152 in the gaming machine. The second end 150*b* is located at the coin collection cup 24.

Figure 16A:
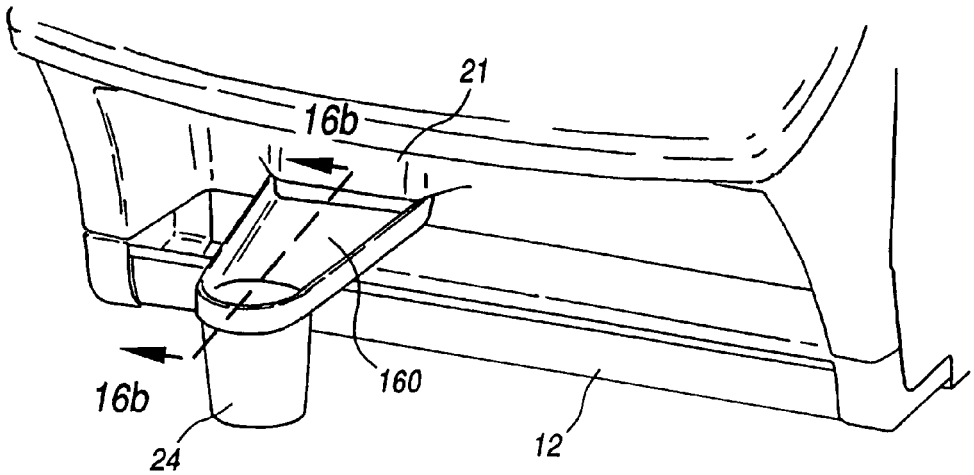
FIG. 16*a* is an enlarged isometric view of a coin collection system according to a fifteenth embodiment of the present invention.
Figure 16B:
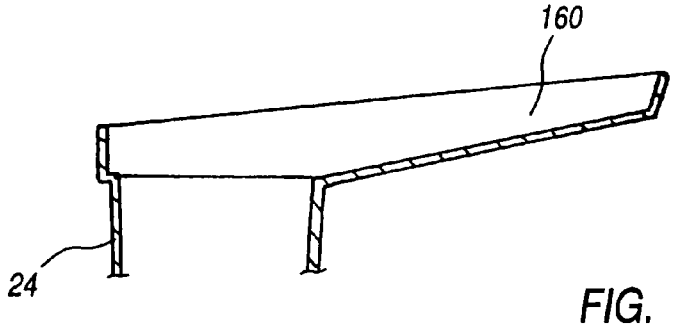
FIG. 16*b* is a sectional view taken generally along line 16*b*—16*b* in FIG. 16*a;*
Figure 17A:
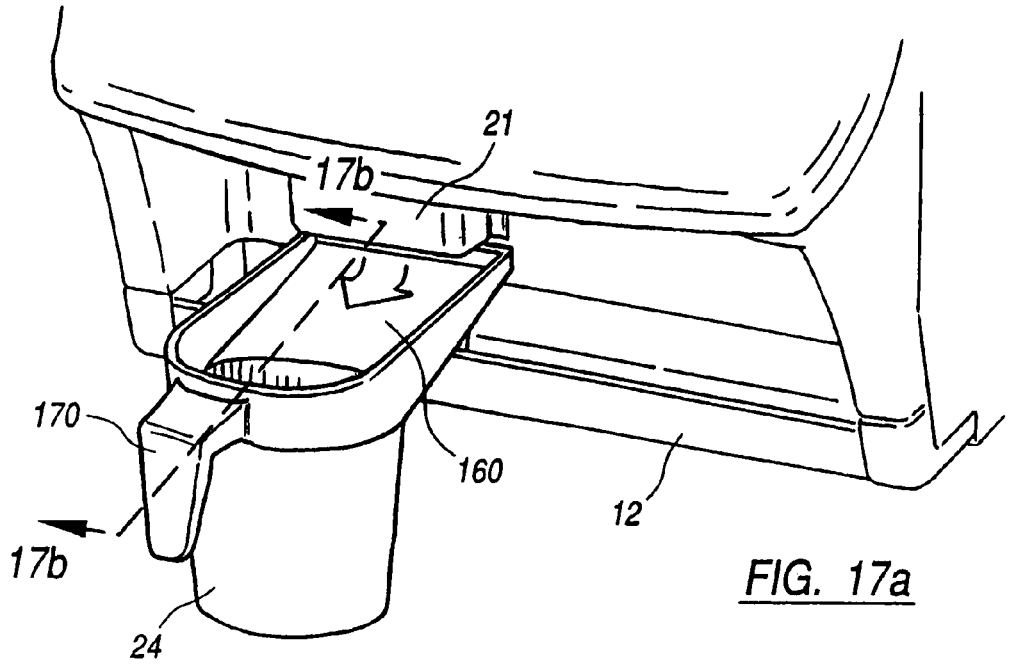
FIG. 17*a* is an enlarged isometric view of a coin collection system according to a sixteenth embodiment of the present invention.
Figure 17B:
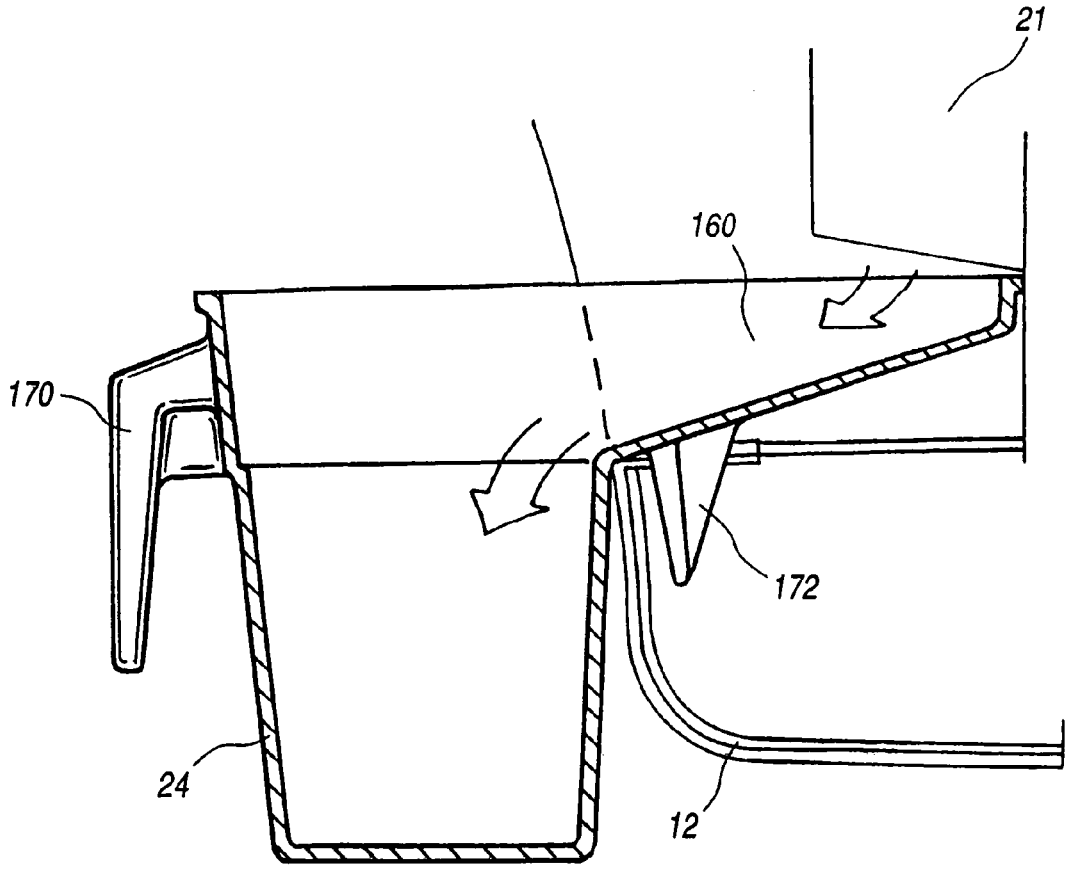
FIG. 17*b* is a sectional view taken generally along line 17*b*—17*b* in FIG. 17*a;*

Referring to FIGS. 16*a* and 16*b*, the guiding member may include a spout 160 detachably coupled to, or integrally formed with, the coin collection cup 24. The cup 24 is held adjacent to the coin tray 12 with the spout 160 extending over the coin tray 12 and having one end beneath the coin outlet 21. The embodiment in FIGS. 17*a* and 17*b* is similar to the embodiment in FIGS. 16*a* and 16*b* except that the cup 24 is also outfitted with a handle 170 and a positioning bar 172. The positioning bar 172 assists the player in maintaining the spout 160 beneath the coin outlet 21 in a correct coin-capturing position.

Figure 18A:
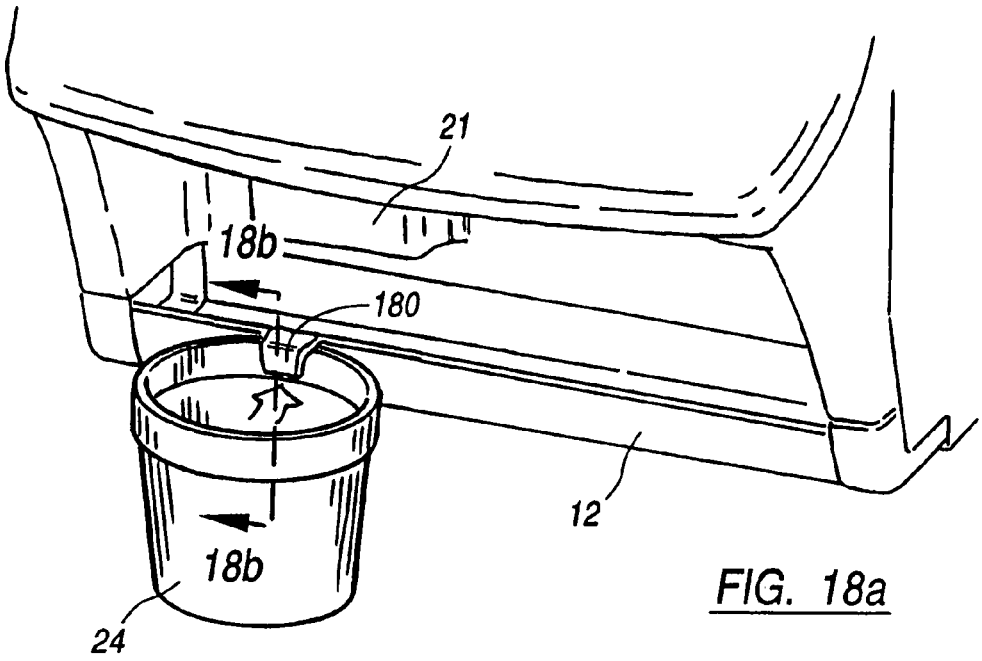
FIG. 18*a* is an enlarged isometric view of a coin collection system according to a seventeenth embodiment of the present invention.
Figure 18B:
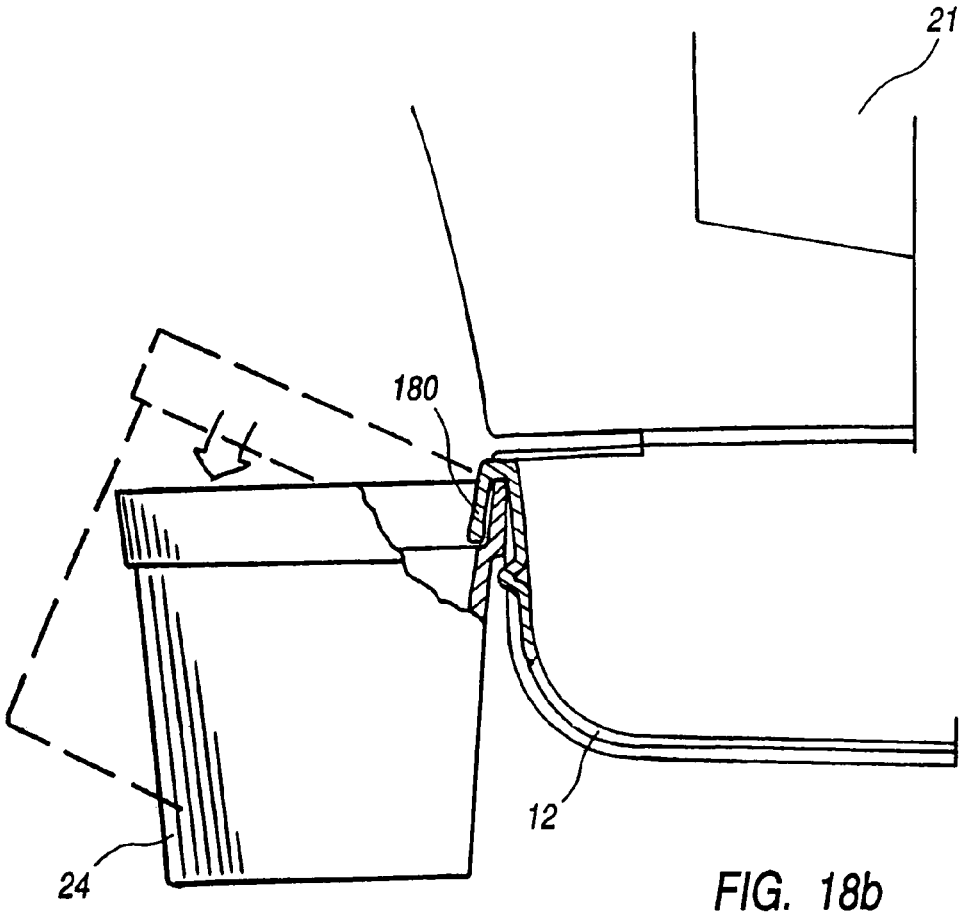
FIG. 18*b* is a sectional view taken generally along line 18*b*—18*b* in FIG. 18*a;*

In accordance with a further aspect of the present invention shown in FIGS. 18*a–b*, a coin collection system for a gaming machine comprises a coin outlet 21 for dispensing coins, a coin tray 12 beneath the coin outlet 21, and a mechanical element for holding a coin collection cup 24 in front of the coin tray 12 so that the coins dispensed into the coin tray 12 can be scooped into the held coin collection cup 24. The mechanical element preferably includes a hook 180 formed by a front wall of the coin tray 12. The coin collection cup 24 is hooked to the coin tray 12 via the hook 180.

Figure 19A:
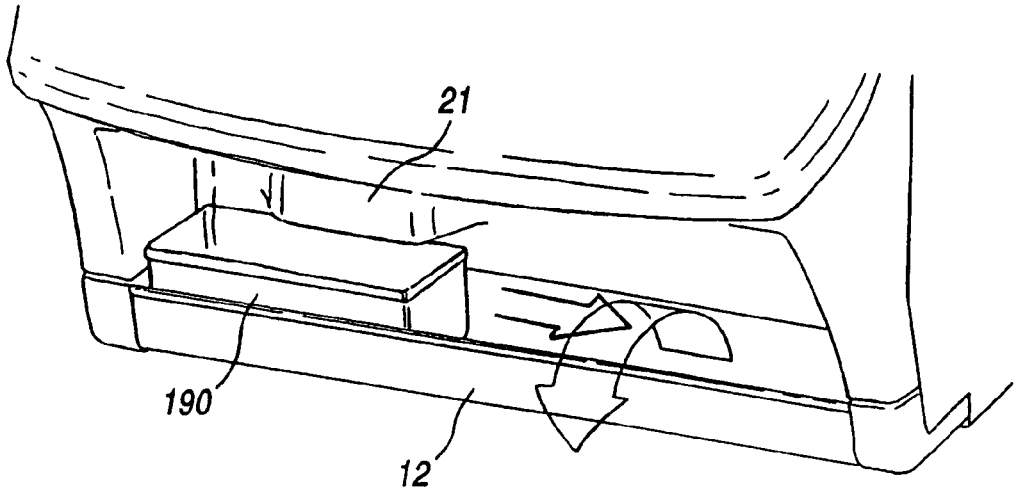
FIGS. 19*a* and 19*b* are enlarged isometric views of a coin collection system according to an eighteenth embodiment of the present invention.
Figure 19B:
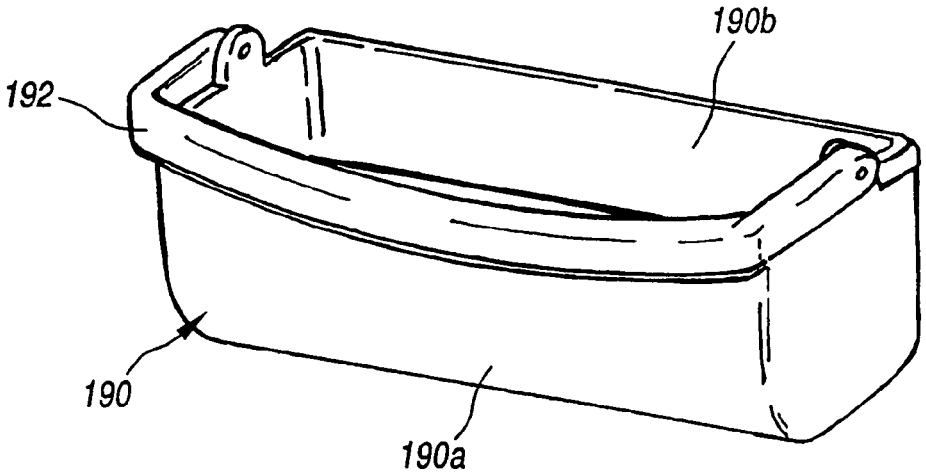

In accordance with yet another aspect of the present invention, a method of collecting coins dispensed from a coin outlet of a gaming machine is disclosed. Referring to FIGS. 19*a* and 19*b*, the gaming machine includes a coin tray 12 beneath the coin outlet 21. In the method, a coin collection cup 190 is obtained from a gaming establishment such as a casino. The cup 190 is sized to sit in the coin tray 12 without being held in place by a player. Next, the coin collection cup 190 is placed within the coin tray 12 beneath the coin outlet 21. The dispensed coins are collected in the coin collection cup 190 placed within the coin tray 12. The coin collection cup 190 is then removed from the coin tray 12. In the illustrated embodiment, the coin collection cup 190 is preferably elongated to fit within the coin tray 12 and sufficiently short in height to slide beneath the coin outlet 21. Specifically, the coin collection cup 190 is generally rectangular in shape and includes opposing front and back walls 190*a* and 190*b* spaced by a width that is less than a width of the coin tray 12. The cup 190 may include a carrying handle 192.

Figure 22A:
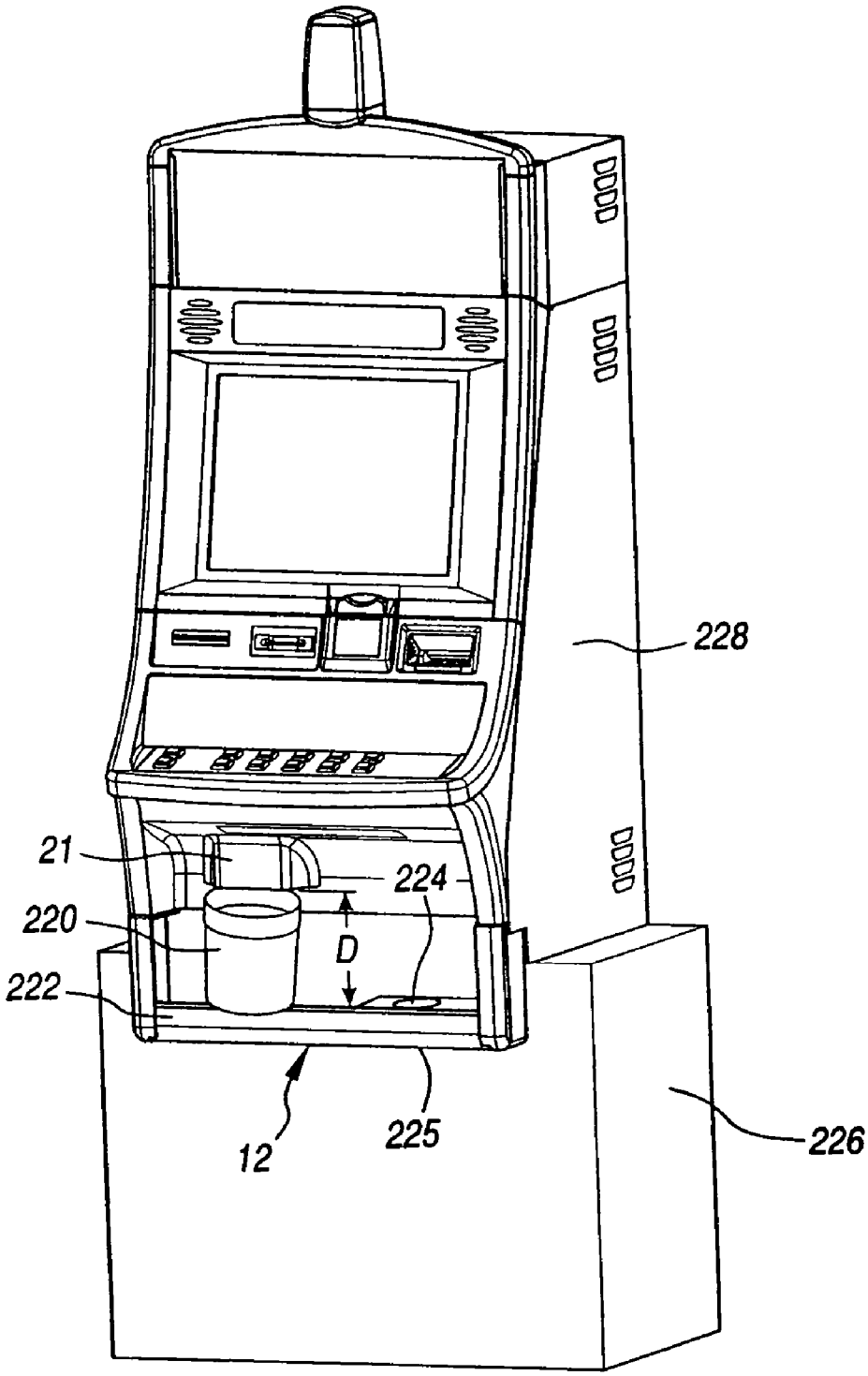
FIGS. 22*a* and 22*b* are isometric views of a coin collection system according to a twenty-first embodiment of the present invention.
Figure 22B:
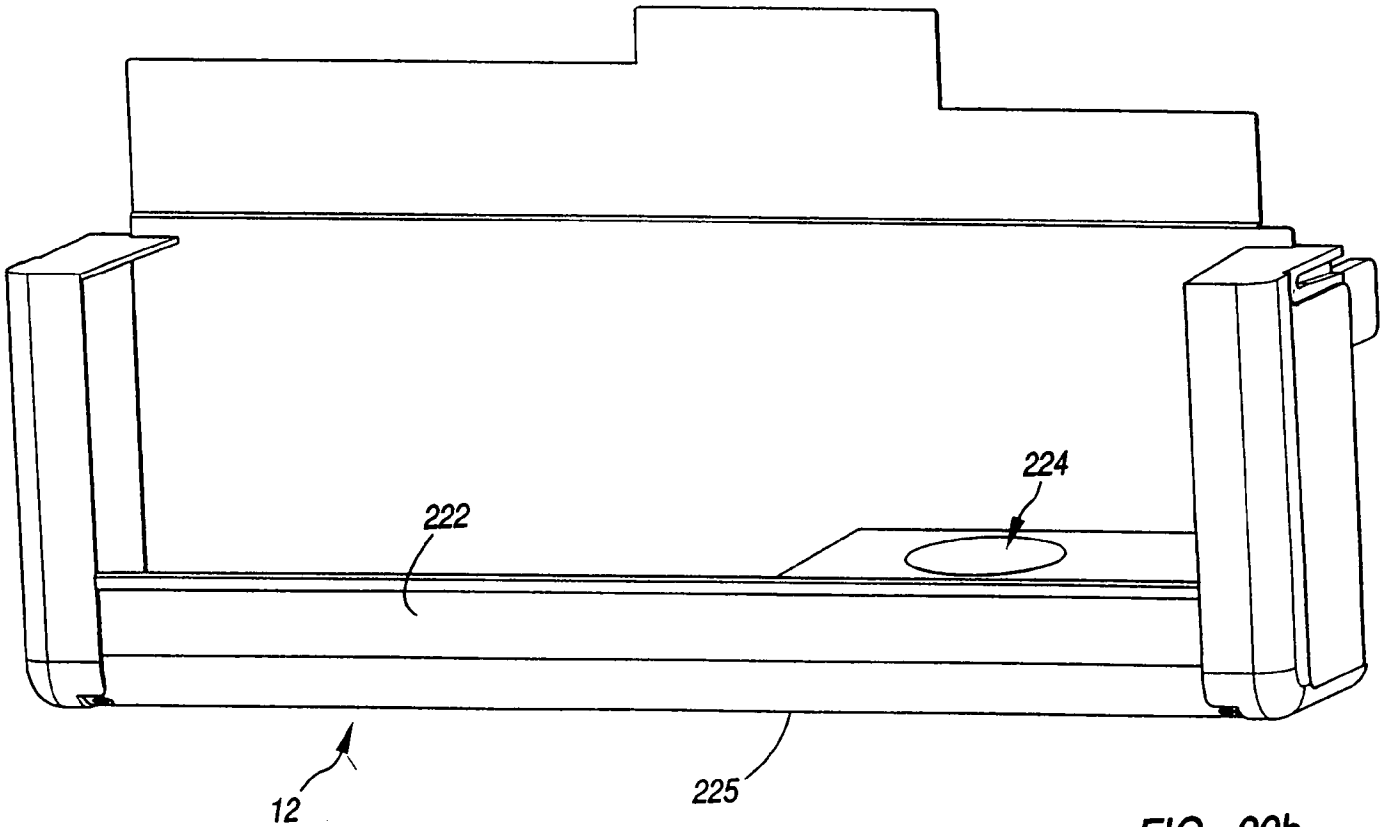

In an alternative embodiment shown in FIGS. 22*a* and 22*b*, the gaming machine includes a coin tray 12 beneath the coin outlet 21, but an upper end of the coin tray 12 is suspended at a greater vertical distance D from the coin outlet 21 than in a traditional gaming machine. The distance D is sufficiently large to accommodate a traditional coin collection cup 220. To accommodate most traditional coin collection cups, the distance D is preferably at least about 5.5 inches and, most preferably, at least 6 inches.

To collect coins to be dispensed from the gaming machine, the coin collection cup 220 is obtained from a gaming establishment such as a casino. Next, the coin collection cup 220 is placed within the coin tray 12 beneath the coin outlet 21. Depending upon the configuration of the coin tray 12, the coin collection cup 220 may or may not need to be held in place by a player. As illustrated, the cup 220 can sit on an upper end of a front wall 222 of the coin tray 12 without being held by the player. Alternatively, the front wall 222 may have a projection or bulge at the location of the coin outlet 21 so that the cup 220 can sit on a bottom wall 225 of the coin tray 21. The projection notifies the player as to where to place the cup 220 in order to receive coins dispensed from the coin outlet 21. The dispensed coins are collected in the coin collection cup 220 sitting on or within the coin tray 12. The coin collection cup 220 is then removed from the coin tray 12. Instead of collecting dispensed coins directly in the coin collection cup 220, the player may elect to allow the dispensed coins to fall into the coin tray 12 and then scoop them by hand into the coin collection cup 220 in conventional fashion. Therefore, the embodiment in FIGS. 22*a* and 22*b* provides the player with the option of using or bypassing the coin tray 12 when collecting coins dispensed from the coin outlet 21.

The embodiment in FIGS. 22*a* and 22*b* has other unique aspects. For example, the coin tray 12 preferably contains a round beverage holder 224. The beverage holder 224 is preferably located near an end of the coin tray 12, away from the coin outlet 21. Depending upon the needs of the gaming establishment, the beverage holder 224 may be sized to receive beverage cups, glasses, and/or bottles such as beer bottles. Like the beverage holders found in many motor vehicles, the beverage holder 224 may be designed to accommodate cups, glasses, and/or bottles of different diameters. The beverage holder 224 may be integrally formed with the coin tray 12, or separately formed and later attached to the coin tray 12. For example, the beverage holder 224 may be formed in an elongated plastic, foam, or metal member that is inserted into and attached to the coin tray 12. The elongated member may be solid or hollow. A bottom of the beverage holder 224 and the portion of the coin tray 12 beneath the beverage holder 224 may have apertures or holes for draining any liquid that may spill or drip into the beverage holder 224. In addition to the beverage holder 224, the coin tray may include an ash tray with a removable heat-resistant cup to facilitate emptying of collected ashes.

Another unique aspect of the embodiment in FIGS. 22*a* and 22*b* is that when the gaming machine sits on a traditional stand 226 in a gaming establishment, a height of the gaming machine is not increased (relative to a gaming machine with a traditional coin tray) as a result of the greater vertical distance D between the coin outlet 21 and the coin tray 12. To avoid increasing the height of the gaming machine, the machine's cabinet 228 has the same height as the cabinet of a machine with a traditional coin tray. However, when the cabinet 228 sits on top of the stand 226, the is coin tray 12 hangs down over a front wall of the stand 226. The coin tray 12 and a bottom of the cabinet 228 preferably form a right angle (90 degree angle) to help locate the gaming machine relative to the stand 226. In contrast, a gaming machine with a traditional coin tray sits entirely on top of the stand 226 with no part of the coin tray hanging down over a front wall of the stand.

Figure 20A:
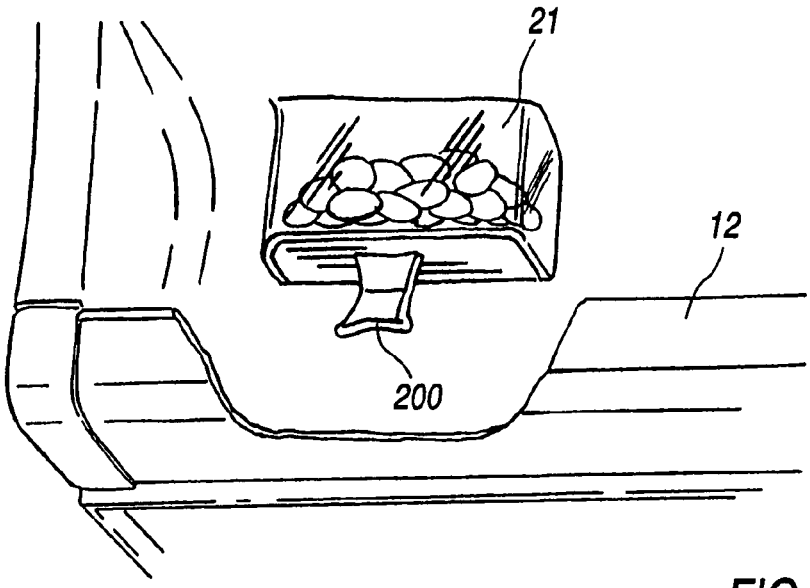
FIGS. 20*a* and 20*b* are enlarged isometric views of a coin collection system according to a nineteenth embodiment of the present invention.
Figure 20B:
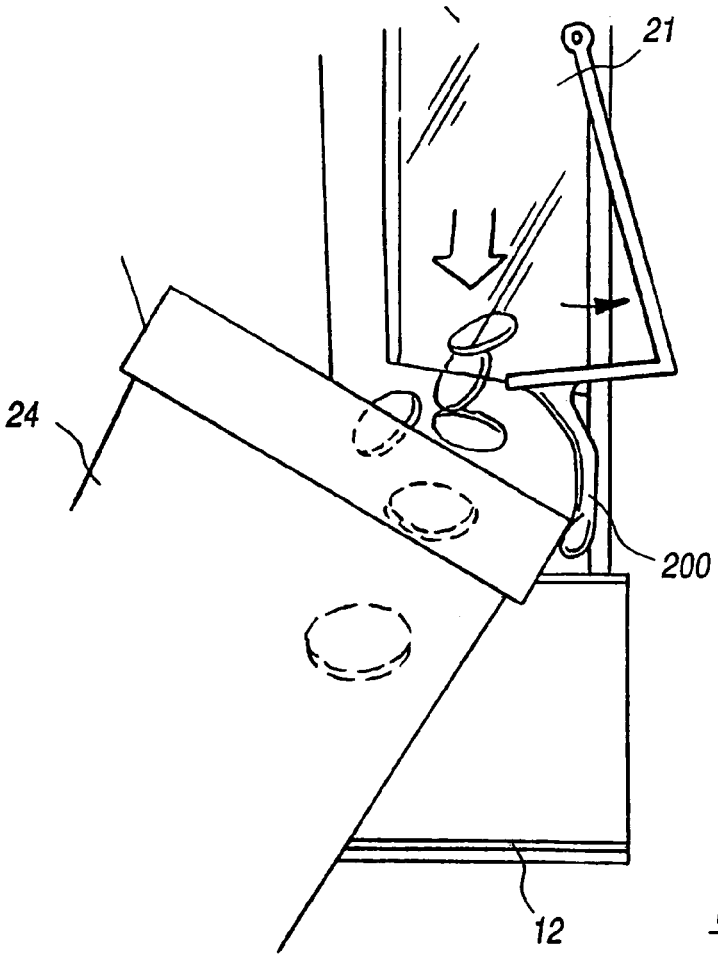

In accordance with yet a further aspect of the present invention depicted in FIGS. 20*a* and 20*b*, a coin collection system for a gaming machine comprises a release bar 200 and a coin outlet 21 proximate the release bar 200. The coin outlet 21 dispenses coins into a coin collection cup 24 positioned beneath the coin outlet 2*i* in response to pressing the release bar 200 with the coin collection cup 24 or a player's hand. The release bar 200 is similar to a bar typically found on soda or ice dispensing machines. Prior to pressing the release bar 200, the coins may be collected in some type of collection chamber within the gaming machine proximate (e.g., above) the coin outlet 21. The collection chamber may, for example, be immediately above the coin outlet 21 and may be transparent or translucent so that the player can view the coins available for collection. The gaming machine is preferably still outfitted with a coin tray 12 beneath the coin outlet 21 as a "fail-safe" to capture any coins that may be missed by the coin collection cup 24 due to improper use or activation of the release bar 200. Also, the release bar 200 may be used in conjunction with some of the other illustrated embodiments, such as the hinged concave panel 40 in FIGS. 4*a* and 4*b*. In fact, instead of having a separate release bar 200, the hinged concave panel 40 may serve as the release bar.

While the present invention has been described with reference to one or more particular embodiments, those skilled in the art will recognize that many changes may be made thereto without departing from the spirit and scope of the present invention. For example, in those embodiments where the dispensed coins first make contact with something (e.g., cup 24 or spout) other than the coin tray 12 and therefore may not generate the familiar and, to some players, exciting clanking sound upon contact, the game software may be modified to simulate clanking sounds through the machine's audio speaker(s) as the coins are dispensed. Each of these embodiments and obvious variations thereof is contemplated as falling within the spirit and scope of the claimed invention, which is set forth in the following claims.

What is claimed is:

1. A coin collection system for a gaming machine, said gaming machine being adapted to accept a wager and to depict indicia corresponding to an outcome of a wagering game, said coin collection system comprising:

a coin outlet for dispensing coins from the gaming machine;

a coin tray beneath the coin outlet; and a guiding arrangement including a movable member coupled to the gaming machine and operable to assist in guiding the dispensed coins from one of the coin outlet and the coin tray to a coin collection cup, the guiding arrangement includes an exit opening in one end of the coin tray, the movable member including a sliding bar for sweeping coins in the coin tray through the exit opening and into the coin collection cup when the cup is held adjacent to the exit opening.

2. The system of claim 1, wherein the sliding bar is slidably anchored to the coin tray for movement between a first position to one side of both the exit opening and the coin outlet and a second position adjacent to the exit opening.

3. A gaming machine being adapted to accept a wager and to depict indicia corresponding to an outcome of a wagering game, the gaming machine comprising:

a coin tray for receiving dispensed coins;

a coin exit opening associated with the coin tray;

a movable member coupled to the gaming machine and located within the coin tray, the moveable member urging the dispensed coins within the coin tray toward the coin exit opening.

4. The gaming machine of claim 3, further comprising a coin outlet for dispensing coins from the gaming machine.

5. The gaming machine of claim 4, wherein the coin tray is located beneath the coin outlet.

6. The gaming machine of claim 3, wherein the movable member includes a sliding bar for sweeping the dispensed coins through the coin exit opening.

7. The gaming machine of claim 6, wherein the dispensed coins are swept through the coin exit opening into a coin collection cup held adjacent to the coin exit opening.

8. The gaming machine of claim 6, wherein the sliding bar is slidably anchored to the coin tray for movement between a first position to one side of both the exit opening and the coin outlet and a second position adjacent to the exit opening.

9. A method of collecting coins from a gaming machine comprising:

accepting a wager;

executing a game in response to the wager;

randomly selecting one of a plurality of possible outcomes of the game;

awarding winnings to a player in response to certain ones of the plurality of possible outcomes;

dispensing coins from a coin outlet into a coin tray; and guiding the dispensed coins with a moveable member located within the coin tray to a coin exit opening in the coin tray.

10. The method of claim 9, wherein the moveable member includes a sliding bar.

11. The method of claim 10, wherein the act of guiding the dispensed coins includes sweeping the dispensed coins to the coin exit opening using the sliding bar.

12. The method of claim 11, wherein the dispensed coins are swept through the coin exit opening into a coin collection cup held adjacent to the coin exit opening.

13. The method of claim 10, wherein the sliding bar is slidably anchored to a coin tray for movement between a first position to one side of both the exit opening and the coin outlet and a second position adjacent to the exit opening.

* * * * *